US005384893A

United States Patent [19]

Hutchins

[11] Patent Number: 5,384,893

[45] Date of Patent: Jan. 24, 1995

[54] METHOD AND APPARATUS FOR SPEECH SYNTHESIS BASED ON PROSODIC ANALYSIS

[75] Inventor: Sandra E. Hutchins, Del Mar, Calif.

[73] Assignee: Emerson & Stern Associates, Inc., San Diego, Calif.

[21] Appl. No.: 949,208

[22] Filed: Sep. 23, 1992

[51] Int. Cl.[6] ..... G10L 9/00

[52] U.S. Cl. ..... 395/2.76; 395/2.67

[58] Field of Search ..... 381/51-53; 395/2.67-2.78

[56] References Cited

U.S. PATENT DOCUMENTS

| | | | |
|---|---|---|---|
| 3,704,345 | 11/1972 | Coker et al. | 179/15 A |
| 4,214,125 | 7/1980 | Mozer et al. | 179/1 SM |
| 4,314,105 | 2/1982 | Mozer | 179/15.55 R |
| 4,384,170 | 5/1983 | Mozer et al. | 179/1 SM |
| 4,433,434 | 2/1984 | Mozer | 381/30 |
| 4,435,831 | 3/1984 | Mozer | 381/30 |
| 4,458,110 | 7/1984 | Mozer | 381/32 |
| 4,624,012 | 11/1986 | Lin et al. | 381/51 |
| 4,685,135 | 8/1987 | Lin et al. | 381/52 |
| 4,692,941 | 9/1987 | Jacks et al. | 381/52 |
| 4,695,962 | 9/1987 | Goudie | 364/513.5 |
| 4,797,930 | 1/1989 | Goudie | 381/52 |
| 4,831,654 | 5/1989 | Dick | 381/51 |
| 4,833,718 | 5/1989 | Sprague | 381/52 |
| 4,852,168 | 7/1989 | Sprague | 381/35 |
| 4,872,202 | 10/1989 | Fette | 381/52 |
| 4,896,359 | 1/1990 | Yamamoto et al. | 381/52 |
| 4,907,279 | 3/1990 | Higuchi et al. | 381/52 |
| 4,912,768 | 3/1990 | Benbassat | 381/52 |
| 4,964,167 | 10/1990 | Kunizawa et al. | 381/52 |
| 4,975,957 | 12/1990 | Ichikawa et al. | 381/36 |

OTHER PUBLICATIONS

D. Klatt, "Software for a Cascade/Parallel Formant Synthesizer", *J. Acoust. Soc. of Amer.*, vol. 67, pp. 971-994 (Mar. 1980).

D. Malah, "Time-Domain Algorithms for Harmonic Bandwidth Reduction and Time Scaling of Speech Signals", *IEEE Trans. on Acoustic, Speech and Signal Processing*, vol. ASSP-27, pp. 121-133 (Apr. 1979).

F. Lee, "Time Compression and Expansion of Speech by the Sampling Method", *J. Audio Eng'g Soc.*, vol. 20, pp. 738-742 (Nov. 1972).

T. Sakai et al., "On-Line, Real-Time, Multiple-Speech Output System", *Proc. Int'l Fed. for Info. Processing Cong.* Booklet TA-4 Ljubljana, Yugoslavia (Aug. 1971) pp. 3-7.

T. Tremain, "The Government Standard Linear Predictive Coding Algorithm: LPC-10", *Speech Technology*, vol. 1, No. 2, pp. 40-49 (Apr. 1982).

*Primary Examiner*—Allen R. MacDonald
*Assistant Examiner*—Michelle Doerrler
*Attorney, Agent, or Firm*—Burns, Doane, Swecker & Mathis

[57] ABSTRACT

A system for synthesizing a speech signal from strings of words, which are themselves strings of characters, includes a memory in which predetermined syntax tags are stored in association with entered words and phonetic transcriptions are stored in association with the syntax tags. A parser accesses the memory and groups the syntax tags of the entered words into phrases according to a first set of predetermined grammatical rules relating the syntax tags to one another. The parser also verifies the conformance of sequences of the phrases to a second set of predetermined grammatical rules relating the phrases to one another. The system retrieves the phonetic transcriptions associated with the syntax tags that were grouped into phrases conforming to the second set of rules, and also translates predetermined strings of characters into words. The system generates strings of phonetic transcriptions and prosody markers corresponding to respective strings of the words, and adds markers for rhythm and stress to the strings, which are then converted into data arrays having prosody information on a diphone-by-diphone basis. Predetermined diphone waveforms are retrieved from memory that correspond to the entered words, and these retrieved waveforms are adjusted based on the prosody information in the arrays. The adjusted diphone waveforms, which may also be adjusted for coarticulation, are then concatenated to form the speech signal. Methods in a digital computer are also disclosed.

11 Claims, 11 Drawing Sheets

METHOD AND APPARATUS FOR SPEECH SYNTHESIS BASED ON PROSODIC ANALYSIS

BACKGROUND

The present invention relates to methods and apparatus for synthesizing speech from text.

A wide variety of electronic systems that convert text to speech sounds are known in the art. Usually the text is supplied in an electrical digitally coded format, such as ASCII, but in principle it does not matter how the text is initially presented. Every text-to-speech (TTS) system, however, must convert the input text to a phonetic representation, or pronunciation, that is then converted into sound. Thus, a TTS system can be characterized as a transducer between representations of the text. Much effort has been expended to make the output of TTS systems sound "more natural" viz more like speech from a human and less like sound from a machine.

A very simple system might use merely a fixed dictionary of word-to-phonetic entries. Such a dictionary would have to be very large in order to handle a sufficiently large number of words, and a high-speed processor would be necessary to locate and retrieve entries from the dictionary with sufficiently high speed.

To help avoid such drawbacks, other systems, such as that described in U.S. Pat. No. 4,685,135 to Lin et al., use a set of rules for conversion of words to phonetics. In the Lin system, phonetics-to-sound conversion is accomplished with allophones and linear predictive coding (LPC), and stress marks must be added by hand in the input text stream. Unfortunately, a system using a simplistic set of rules for converting words to phonetic representations will inevitably produce erroneous pronunciations for some words because many languages, including English, have no simple relationship between orthography and pronunciation. For example, the orthography, or spelling, of the English words "tough", "though", and "through" bears little relation to their pronunciation.

Accordingly, some systems, such as that described in U.S. Pat. No. 4,692,941 to Jacks et al., convert orthography to phonemes by first examining a keyword dictionary (giving pronouns, articles, etc.) to determine basic sentence structure, then checking an exception dictionary for common words that fail to follow the rules, and then reverting to the rules for words not found in the exception dictionary. In the system described in the Jacks et al. patent, the phonemes are converted to sound using a time-domain technique that permits manipulation of pitch. The patent suggests that inflection, speech and pause data can be determined from the keyword information according to standard rules of grammar, but those methods and rules are not provided, although the patent mentions a method of raising the pitch of words followed by question marks and lowering the pitch of words followed by a periods.

Another prior TTS system is described in U.S. Pat. No. 4,979,216 to Malsheen et al., which uses rules for conversion to phonetics and a large exception dictionary of 3000–5000 words. The basic sound unit is the phoneme or allophone, and parameters are stored as formants.

Such systems inevitably produce erroneous pronunciations because many languages have words, or character strings, that have several pronunciations depending on the grammatical roles the strings play in the text. For example, the English strings "record" and "invalid" both have two pronunciations in phrases such as "to record a new record" and "the invalid's invalid check".

In dealing with such problems, most prior TTS systems either avoid or treat secondarily the problem of varying the stress of output syllables. A TTS system could ignore stress variations, but the result would probably be unintelligible as well as sound unnatural. Some systems, such as that described in the Lin patent cited above, require that stress markers be inserted in the text by outside means: a laborious process that defeats many of the purposes of a TTS system.

"Stress" refers to the perceived relative force with which a sound, syllable, or word is uttered, and the pattern of stresses in a sequence of words is a highly complicated function of the physical parameters of frequency, amplitude, and duration. "Orthography" refers to the system of spelling used to represent spoken language.

In contrast to the approaches of prior TTS systems, it is believed that the accuracy of stress patterns can be even more important than the accuracy of phonetics. To achieve stress pattern accuracy, however, a TTS system must take into account that stress patterns also depend on grammatical role. For example, the English character strings "address", "export", and "permit" have different stress patterns depending on whether they are used as nouns or verbs. Applicant's TTS system considers stress (and phonetic accuracy in the presence of orthographic irregularities) to be so important that it uses a large dictionary and a natural-language parser, which determines the grammatical role each word plays in the sentence and then selects the pronunciation that corresponds to that grammatical role.

It should be appreciated that Applicant's system does more than merely make an exception dictionary larger; the presence of the grammatical information in the dictionary and the use of the parser result in a system that is fundamentally different from prior TTS systems. Applicant's approach guarantees that the basic glue of English is handled correctly in lexical stress and in phonetics, even in cases that would be ambiguous without the parser. The parser also provides information on sentence structure that is important for providing the correct intonation on phrases and clauses, i.e., for extending intonation and stress beyond individual words, to produce the correct rhythm of English sentences. The parser in Applicant's system enhances the accuracy of the stress variations in the speech produced among other reasons because it permits identification of clause boundaries, even of embedded clauses that are not delimited by punctuation marks.

Applicant's approach is extensible to all languages having a written form in a way that rule-based text-to-phonetics converters are not. For a language like Chinese, in which the orthography bears no relation to the phonetics, this is the only option. Also for languages like Hebrew or Arabic, in which the written form is only "marginally" phonetic (due, in those two cases, to the absence of vowels in most text), the combination of dictionary and natural-language parser can resolve the ambiguities in the text and provide accurate output speech.

Applicant's approach also offers advantages for languages (e.g., Russian, Spanish, and Italian) that may be superficially amenable to rule-based conversion (i.e., where rules might "work better" than for English because the orthography corresponds more closely to the phonetics). For such languages, the combination of a dictionary and parser still provides the information on sentence structure that is critical to the production of correct intonational patterns beyond the simple word level. Also for languages having unpredictable stress (e.g., Russian, English, and German), the dictionary itself (or the combination of dictionary and parser) resolves the stress patterns in a way that a set of rules cannot.

Most prior systems do not use a full dictionary because of the memory required; the Lin et al. patent suggests that a dictionary of English words requires 600 K bytes of RAM. Applicant's dictionary with phonetic and grammatical information requires only about 175 K bytes. Also, it is often assumed that a natural-language parser of English would be too time consuming for practical systems.

This invention is an innovative approach to the problem of text-to-speech synthesis, and can be implemented using only the minimal processing power available on MACINTOSH-type computers available from Apple Computer Corp. The present TTS system is flexible enough to adapt to any language, including languages such as English for which the relationship between orthography and phonetics is highly irregular. It will be appreciated that the present TTS system, which has been configured to run on Motorola M68000 and Intel 80386SX processors, can be implemented with any processor, and has increased phonetic and stress accuracy compared to other systems.

Applicant's invention incorporates a parser for a limited context-free grammar (as contrasted with finite-state grammars) that is described in Applicant's commonly assigned U.S. Pat. No. 4,994,966 for "System and Method for Natural Language Parsing by Initiating Processing prior to Entry of Complete Sentences" (hereinafter "the '966 patent"), which is hereby incorporated in this application by reference. It will be understood that the present invention is not limited in language or size of vocabulary; since only three or four bytes are needed for each word, adequate memory capacity is usually not a significant concern in current small computer systems.

SUMMARY

In one aspect, Applicant's invention provides a system for synthesizing a speech signal from strings of words, which are themselves strings of characters, entered into the system. The system includes a memory in which predetermined syntax tags are stored in association with entered words and phonetic transcriptions are stored in association with the syntax tags. A parser accesses the memory and groups the syntax tags of the entered words into phrases according to a first set of predetermined grammatical rules relating the syntax tags to one another. The parser also verifies the conformance of sequences of the phrases to a second set of predetermined grammatical rules relating the phrases to one another.

The system retrieves the phonetic transcriptions associated with the syntax tags that were grouped into phrases conforming to the second set of rules, and also translates predetermined strings of characters into words. The system generates strings of phonetic transcriptions and prosody markers corresponding to respective strings of the words, and adds markers for rhythm and stress to the strings, which are then converted into data arrays having prosody information on a diphone-by-diphone basis.

Predetermined diphone waveforms are retrieved from memory that correspond to the entered words, and these retrieved waveforms are adjusted based on the prosody information in the arrays. The adjusted diphone waveforms, which may also be adjusted for coarticulation, are then concatenated to form the speech signal.

In another aspect of the invention, the system interprets punctuation marks as requiring various amounts of pausing, deduces differences between declarative, exclamatory, and interrogative word strings, and places the deduced differences in the strings of phonetic transcriptions and prosody markers. Moreover, the system can add extra pauses after highly stressed words, adjust duration before and stress following predetermined punctuation, and adjust rhythm by adding marks for more or less duration onto phonetic transcriptions corresponding to selected syllables of the entered words based on the stress pattern of the selected syllables.

The parser included in the system can verify the conformance of several parallel sequences of phrases and phrase combinations derived from the retrieved syntax tags to the second set of grammatical rules, each of the parallel sequences comprising a respective one of the sequences possible for the entered words.

In another aspect, Applicant's invention provides a method for a digital computer for synthesizing a speech signal from natural language sentences, each sentence having at least one word. The method includes the steps of entering and storing a sentence in the computer, and finding syntax tags associated with the entered words in a word dictionary. Non-terminals associated with the syntax tags associated with the entered words are found in a phrase table as each word of the sentence is entered, and several possible sequences of the found non-terminals are tracked in parallel as the words are entered.

The method also includes the steps of verifying the conformance of sequences of the found non-terminals to rules associated with predetermined sequences of non-terminals, and retrieving, from the word dictionary, phonetic transcriptions associated with the syntax tags of the entered words of one of the sequences conforming to the rules. Another step of the method is generating a string of phonetic transcriptions and prosody markers corresponding to the entered words of that sequence conforming to the rules.

The method further includes the step of adding markers for rhythm and stress to the string of phonetic transcriptions and prosody markers and converting the string into arrays having prosody information on a diphone-by-diphone basis. Predetermined diphone waveforms corresponding to the string and the entered words of the sequence conforming to the rules are then adjusted based on the prosody information in the arrays. As a final step in one embodiment, the adjusted diphone waveforms are concatenated to form the speech signal.

BRIEF DESCRIPTION OF THE DRAWINGS

The features and advantages of Applicant's invention will be understood by reading the following detailed description in conjunction with the drawings in which.

DETAILED DESCRIPTION

Applicant's invention can be readily implemented in computer program code that examines input text and a plurality of suitably constructed lookup tables. It will therefore be appreciated that the invention can be modified through changes to either or both of the program code and the lookup tables. For example, appropriately changing the lookup tables would allow the conversion of input text written in a language other than English.

OVERVIEW of OPERATION

Figure 1:
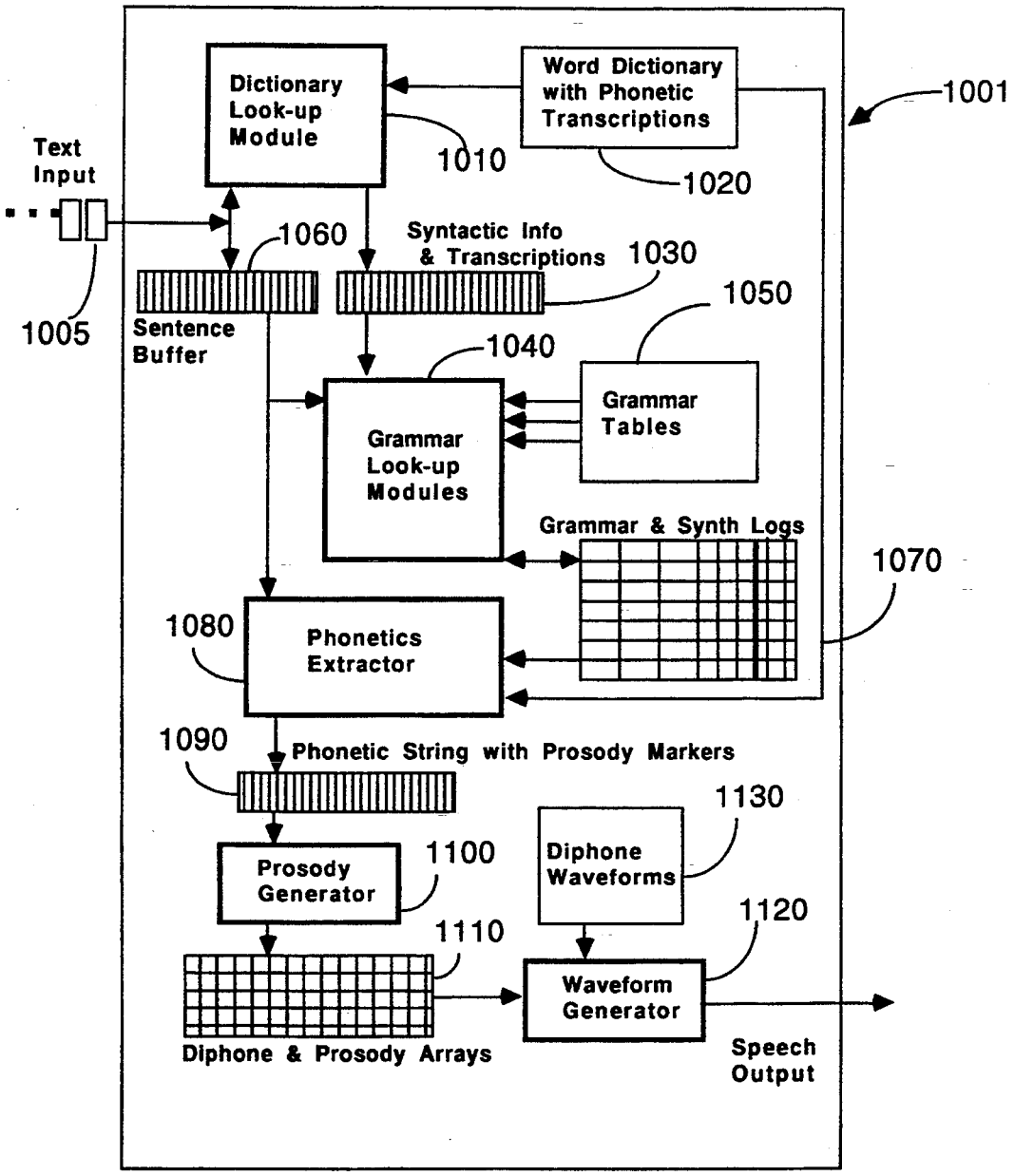
FIG. 1 is a block diagram of a text-to-speech system in accordance with Applicant's invention.

FIG. 1 is a high level block diagram of a TTS system 1001 in accordance with Applicant's invention. Text characters 1005, which may typically be in ASCII format, are presented at an input to the TTS system. It will be appreciated that the particular format and source of the input text does not matter; the input text might come from a keyboard, a disk, another computer program, or any other source. The output of the TTS system 1001 is a digital speech waveform that is suitable for conversion to sound by a digital-to-analog (D/A) converter and loudspeaker (not shown). Suitable D/A converters and loudspeakers are built into MACINTOSH computers and supplied on SOUNDBLASTER cards for DOS-type computers, and many others are available.

As described in Applicant's above-incorporated '966 patent, the input text characters 1005 are fed serially to the TTS system 1001. As each character is entered, it is stored in a sentence buffer 1060 and is used to advance the process in a Dictionary Look-up Module 1010, which comprises suitable program code. The Dictionary Look-up Module 1010 looks up the words of the input text in a Word Dictionary 1020 and finds their associated grammatical tags. Also stored in the Word Dictionary 1020 and retrieved by the Module 1010 are phonetic transcriptions that are associated with the tags. By associating the phonetic transcriptions, or pronunciations, with the tags rather than with the words, input words having different pronunciations for different forms, such as nouns and verbs, can be handled correctly.

An exemplary dictionary entry for the word "frequently" is the following:

frequently AVRB 1fRi2kwYnt2Li in which "AVRB" is a grammatical tag indicating an adverb form. Each number in the succeeding phonetic transcription is a stress level for the following syllable. In a preferred embodiment of the invention, the highest stress level is assigned a value "1" and the lowest stress level is assigned a value "4" although other assignments are possible. It will be appreciated that linguists usually describe stress levels in the manner illustrated, i.e., 1=primary, 2=secondary, etc. As described in more detail below, an Orthography-To-Phonetics (OTP) process is a part of the Dictionary Look-up Module 1010.

In contrast to prior TTS systems, Applicant's TTS system considers stress (and phonetic accuracy in the presence of orthographic irregularities) to be so important that it uses a large dictionary and reverts to other means (such as spelling out a word or guessing at its pronunciation) only when the word is not found in the main dictionary. An English dictionary preferably contains about 12,000 roots or 55,000 words, including all inflections of each word. This ensures that about 95% of all words presented to the input will be pronounced correctly.

The Dictionary Look-up Module 1010 repetitively searches the Word Dictionary 1020 for the input string as each character is entered. When an input string terminates with a space or punctuation mark, such string is deemed to constitute a word and syntactic information and transcriptions 1030 for that character string is passed to Grammar Look-up Modules 1040, which determine the grammatical role each word plays in the sentence and then select the pronunciation that corresponds to that grammatical role. This parser is described in detail in Applicant's '966 patent, somewhat modified to track the pronunciations associated with each tag.

Unlike the parser described in Applicant's '966 patent, it is not necessary for the TTS system 1001 to flag spelling or capitalization errors in the input text, or to provide help for grammatical errors. It is currently preferred that the TTS system pronounce the text as it is written, including errors, because the risk of an improper correction is greater than the cost of proceeding with errors. As described in more detail below, it is not necessary for the parsing process employed in Applicant's TTS system to parse successfully each input sentence. If errors prevent a successful parse, then the TTS system can simply pronounce the successfully parsed parts of the sentence and pronounce the remaining input text word by word.

As mentioned above, the Grammar Look-up Modules 1040 are substantially similar to those described in Applicant's '966 patent. For the TTS system, they carry along a parallel log called the "synth log", which maintains information about the phonetic transcriptions associated with the tags maintained in the path log.

A Phonetics Extractor 1080 retrieves the phonetic transcriptions for the chosen path (typically, there is only one surviving path in the path log) from the dictionary. The pronunciation information maintained in the synth log paths preferably comprises pointers to the places in the dictionary where the transcriptions reside; this is significantly more efficient than dragging around the full transcriptions, which could be done if the memory and processing resources are available.

The Phonetics Extractor 1080 also translates some text character strings, like numbers, into words. The Phonetics Extractor 1080 interprets punctuation as requiring various amounts of pausing, and it deduces the difference between declarative sentences, exclamations, and questions, placing the deduced information at the head of the string. As described further below, the Phonetics Extractor 1080 also generates and places markers for starting and ending various types of clauses in the synth log. The string 1090 of phonetic transcriptions and prosody markers are passed to a Prosody Generator 1100.

The Prosody Generator 1100 has two major functions: manipulating the phonetics string to add markers for rhythm and stress, and converting the string into a set of arrays having prosody information on a diphone-by-diphone basis.

The term "prosody" refers to those aspects of a speech signal that have domains extending beyond individual phonemes. It is realized by variations in duration, amplitude, and pitch of the voice. Among other things, variations in prosody cause the hearer to perceive certain words or syllables as stressed. Prosody is sometimes characterized as having two parts: "intonation", which arises from pitch variations; and "rhythm", which arises from variations in duration and amplitude. "Pitch" refers to the dominant frequency of a sound perceived by the ear, and it varies with many factors such as the age, sex, and emotional state of the speaker.

Among the other terms used in this application is "phoneme" which refers to a class of phonetically similar speech sounds, or "phones" that distinguish utterances, e.g., the /p/ and /t/ phones in the words "pin" and "tin". The term "allophones" refer to the variant forms of a phoneme. For example, the aspirated /p/ of the word "pit" and the unaspirated /p/ of the word "spit" are allophones of the phoneme /p/. "Diphones" are entities that bridge phonemes, and therefore include the critical transitions between phonemes. English has about forty phonemes, about 130 allophones, and about 1500 diphones.

It can thus be appreciated that the terms "intonation", "prosody", and "stress" refer to the listener's perception of speech rather than the physical parameters of the speech.

The Prosody Generator 1100 also implements a rhythm-and-stress process that adds some extra pauses after highly stressed words and adjusts duration before and stress following some punctuation, such as commas. Then it adjusts the rhythm by adding marks onto syllables for more or less duration based on the stress pattern of the syllables. This is called "isochrony". English and some other languages have this kind of timing in which the stressed syllables are "nearly" equidistant in time (such languages may be called "stress timed"). In contrast, languages like Italian and Japanese use syllables of equal length (such languages may be called "syllable timed").

As described above, the Prosody Generator 1100 reduces the string of stress numbers, phonemes, and various extra stress and duration marks on a diphone-by-diphone basis to a set of Diphone and Prosody Arrays 1110 of stress and duration information. It also adds intonation (pitch contour) and computes suitable amplitude and total duration based on arrays of stress and syntactic duration information.

A Waveform Generator 1120 takes the information in the Diphone and Prosody Arrays 1110 and adds "coarticulation", i.e., it runs words together as they are normally spoken without pauses except for grammatically forced pauses (e.g., pauses at clause boundaries). Then the Waveform Generator 1120 proceeds diphone by diphone through the Arrays 1110, adjusting copies of the appropriate diphone waveforms stored in a Diphone Waveform look-up table 1130 to have the pitch, amplitude, and duration specified in the Arrays 1110. Each adjusted diphone waveform is concatenated onto the end of the partial utterance until the entire sentence is completed.

It will be appreciated that the processes for synthesizing speech carried out by the Phonetics Extractor 1080, Prosody Generator 1100, and Waveform Generator 1120 depend on the results of the parsing processes carried out by the Dictionary and Grammar Modules 1010, 1020 to obtain reasonably accurate prosody. As described in Applicant's '966 patent, the parsing processes can be carried out in real time as each character in the input text is entered so that by the time the punctuation ending a sentence is entered the parsing process for that sentence is completed. As the next sentence of the input text is entered, the synthesizing processes can be carried out on the previous sentence's results. Thus, depending on parameters such as processing speed, synthesis could occur almost in real time, just one sentence behind the input. Since synthesis may not be completed before the end of the next sentence's parse, the TTS system would usually need an interrupt-driven speech output that can run as a background process to obtain quasi-real-time continuous output. Other ways of overlapping parsing and synthesizing could be used.

DETAILED DESCRIPTION OF OPERATION

The embodiment described here is for English, but it will be appreciated that this embodiment can be adapted to any written language by appropriate modifications.

DICTIONARY LOOK-UP

The term "dictionary" as used here includes not only a "main" dictionary prepared in advance, but also word lists supplied later (e.g., by the user) that specify pronunciations for specific words. Such supplemental word lists would usually comprise proper nouns not found in the main dictionary.

Structure of Entries

Each entry in the Word Dictionary 1020 contains the orthography for the entry, its syntactical tags, and one or more phonetic transcriptions. The syntactical tags listed in Table I of the above-incorporated '966 patent are suitable, but are not the only ones that could be used. In the preferred embodiment of Applicant's TTS system, those tags are augmented with two more, called "proper noun premodifier" (NPPR) and "proper noun post-modifier" (NPPO), which permit distinguishing pronunciations of common abbreviations, such as "doctor" versus "drive" for "Dr." As described above, the phonetic transcriptions are associated with tags or groups of tags, rather than with the orthography, so that pronunciations can be discriminated by the grammatical role of the respective word.

Table I below lists several representative dictionary entries, including tags and phonetic transcriptions, and Table II below lists the symbols used in the transcriptions. In Table I, the notation "(TAG1 TAG2)" specifies a pair of tags acting as one tag as described in Applicant's '966 patent. In addition to symbols for one standard set of phonemes, the transcriptions advantageously include symbols for silence (#) and three classes of non-transcriptions (? , *, and ^ ).

The silence symbol is used to indicate a pause in pronunciation (see, for example, the entry "etc." in Table I) and also to delimit all transcriptions as shown in Table I. The ? symbol is used to indicate entries that need additional processing of the text to determine their pronunciation. Accordingly, the ? symbol is used primarily with numbers. In the dictionary look-up process, the digits 2–9 and 0 are mapped to a "2" for purposes of look up and the digit "1" is mapped to a "1". This reduces the number of distinct entries required to represent numbers. In addition, it is desirable (as described below with respect to the Phonetics Extractor 1080) to pronounce numbers in accordance with standard English (e.g., "one hundred forty-seven") rather than simply reading the names of the digits (e.g., "one four seven").

The * symbol is used to indicate a word for which special pronunciation rules may be needed. For example, in some educational products it is desirable to spell out certain incorrect forms (e.g., "ain't"), rather than give them apparently acceptable status by pronouncing them. The ^ symbol is used as the transcription for punctuation marks that may affect prosody but do not have a phonetic pronunciation. Also, provisions for using triphones may be included, depending on memory limitations, because their use can help produce high-quality speech; phonetic transcription symbols for three triphones are included in Table II.

Choice of Phonemes

Lists of English phonemes are available from a variety of sources, e.g., D. O'Shaughnessy, Speech Communication, p. 45, Addison-Wesley (1987)(hereinafter "O'Shaughnessy"). Most lists include about forty phonemes. The list in Table II below differs from most standard lists in having two unstressed allophones, ")" and "Y", of stressed vowels and in having a larger number of variants of liquids. In Table II, "R""x", and "L" are standard, but "r", "X", and "l" are added allophones. Also, Table II includes the additional stops "D" and "T" for mid-word allophones of those phonemes.

It will be appreciated that the number of phonemes that should be used depends on the dialect to be produced by the TTS system. For example, some dialects of American English include the sound "O" shown in Table II and others use "a" in its place. The "O" might not be used when the TTS system implements a dialect that makes no distinction between "O" and "a". (The particular symbols selected for the Table are somewhat arbitrary, but were chosen merely to be easy to print in a variety of standard printer fonts.)

Table II also indicates three consonant clusters that have been used to implement triphones. In the interest of saving memory, however, it is possible to dispense with the consonant clusters.

Basic Look-up Scheme

The process implemented by the Dictionary Look-up Module 1010 for retrieving information from the Word Dictionary 1020 is preferably a variant of the Phrase Parsing process described in the '966 patent in connection with FIGS. 5*a*–5*c*. In the TTS system 1001, dictionary characters take the place of grammatical tags and dictionary tags take the place of non-terminals. The packing scheme for the Word Dictionary 1020 is similarly analogous to that given for phrases in the '966 patent. It will be appreciated that other packing schemes could be used, but this one is highly efficient in its use of memory.

Orthography-to-Phonetics (OTP) Conversion

When a word in the input text is not found in the Word Dictionary 1020, the TTS system 1001 either spells out the characters involved (e g , for an input string "kot" the system could speak "kay oh tee") or attempts to deduce the pronunciation from the characters present in the input text. For deducing a pronunciation, a variety of techniques (e.g., that described in the above-cited patent to Lin et al.) could be used.

In Applicant's TTS system 1001, the Word Dictionary 1020 is augmented with tables of standard suffixes and prefixes, and the Dictionary Look-up Module 1010 produces deduced grammatical tags and pronunciations together. In particular, the suffix table contains both pronunciations for endings and the possible grammatical tags for each ending. The Dictionary Look-up Module 1010 preferably deduces the syntax tags for words not found in the Word Dictionary 1020 in the manner explained in the '966 patent.

The OTP process in the Dictionary Look-up Module 1010 implements the following steps to convert unknown input words to phoneme strings having stress marks.

1. Determine whether the word begins with "un" or "non". If so, the appropriate phonetic string for the prefix is output to a convenient temporary storage area, and the prefix is stripped from the orthography string in the Sentence Buffer 1060.

2. Determine whether the word ends in "ate". In English, this is a special case to track since the output in the temporary storage area will have two pronunciations with two tag sets in the form:

VB<root>2et and

ADJ NABS<root>3Yt

For example, the word "estimate" has two pronunciations, as in "estimate the cost" and "a cost estimate". Other languages may have their own special cases that can be handled in a similar way. A flag is set indicating that all further expansion of the root pronunciation must expand both sections of the root.

3. Iteratively build up the pronunciation of the end of the word in the temporary storage area by comparing the end of the orthography in the Sentence Buffer 1060 to the suffix table, and, if a match is found:

a. stripping the suffix from the orthography;

b. outputting the appropriate phonetic transcription and syntax tags found in the suffix table; and c. checking for the resulting root in the dictionary.

This continues until either no more suffixes can be found in the suffix table or the resulting root is found in the dictionary. The syntax tags included in the temporary storage area are only those retrieved from the suffix table for the first suffix stripped (i.e., the last suffix in the unknown word).

For example for the input string "preconformingly" the first "ly" suffix is stripped (and the syntax tag for an adverb is retrieved), and then the "ing" suffix is stripped. The resulting root is "preconform", for which no more suffix stripping can be performed, and the phonetic transcription information so far is:

<beginning missing>3iN3Li

4. Iteratively build up the pronunciation of the beginning of the unknown word by matching the beginning to the entries in the prefix table, and, if a match is found:

a. outputting the pronunciation from the table;

b. stripping the prefix; and c. checking for the resulting root in the dictionary.

This is done until no more prefixes can be found or until the resulting root appears in the dictionary. The resulting root for the foregoing example is "conform" as the remaining orthography. This root is in the dictionary, and the complete phonetics are:

3pRi2kan1form3iN3Li

5. If step 4 fails, determine whether the remaining orthography consists of two roots in the dictionary (e.g., "desktop"), and if so concatenate the pronunciations of the two roots. Applicant's current OTP process divides the remaining orthography after the first character and determines whether the resulting two pieces are roots in the dictionary; if not, the remaining orthography is divided after the second character, and those pieces are examined. This procedure continues until roots have been found or all possible divisions have been checked.

6. If step 5 fails, proceed to convert whatever remains of the root via letter-to-sound rules, viz., attempt to generate a phonetic transcription for whatever remains according to very simple rules.

When processing is completed, the Dictionary Lookup Module 1010 transfers the syntax tags and phonetic transcriptions in the temporary storage area to the Syntactic Info and Transcriptions buffer 1030.

Entries in the suffix table specify orthography, pronunciation and grammatical tags, preferably in that order, and the following are typical entries in the suffix table:

| | | |
|---|---|---|
| matic | 1mA3tik | ADJ NABS |
| atic | 1A3tIk | ADJ NABS |
| ified | 3Y4fJd | ADJ VBD |
| ward | 3wxd | ADJ |

Entries in the prefix table contain orthography and pronunciations, and the following are typical entries:

| | |
|---|---|
| archi | 3ar4kY |
| bi | 3bJ |
| con | 3kan |
| extra | 3Eks4tR) |

Structure of Output

Although many OTP processes could-be used, the output of a suitable process, i.e., the syntactic information and phonetic transcriptions, must have a format that is identical to the format of the output from the Word Dictionary 1020, i.e., grammatical tags and phonetic transcriptions.

Figure 2:
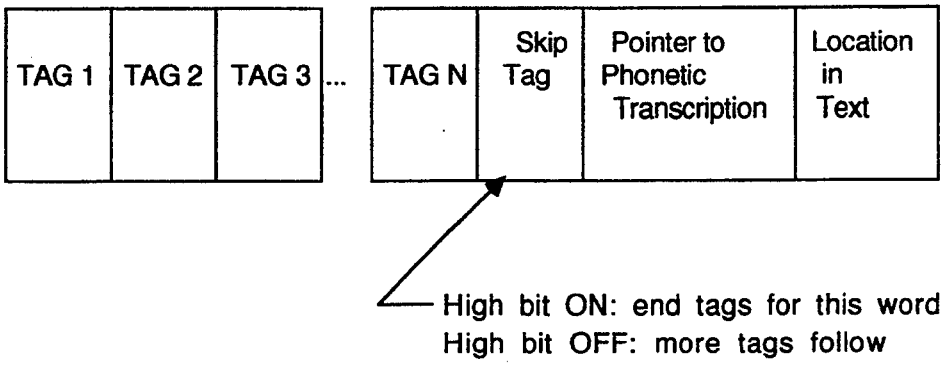
FIG. 2 shows a basic format for syntactic information and transcriptions of FIG. 1.

The Syntactic Information and Transcriptions 1030 is passed to the Grammar Modules 1040 and has a basic format as shown in FIG. 2 comprising one or more grammatical tags 1-N, a Skip Tag, and pointers to a phonetic transcription and a location in the input text. This structure permits associating a pronunciation (corresponding to the phonetic transcription) with a syntax tag or group of tags. It also keys the tag(s) and transcription back to a location (the end of a word) in the input text in the Sentence Buffer 1060. The key back to the text is particularly important for transcriptions using the "?" symbol because later processes examine the text to determine the correct pronunciation.

Figure 3:
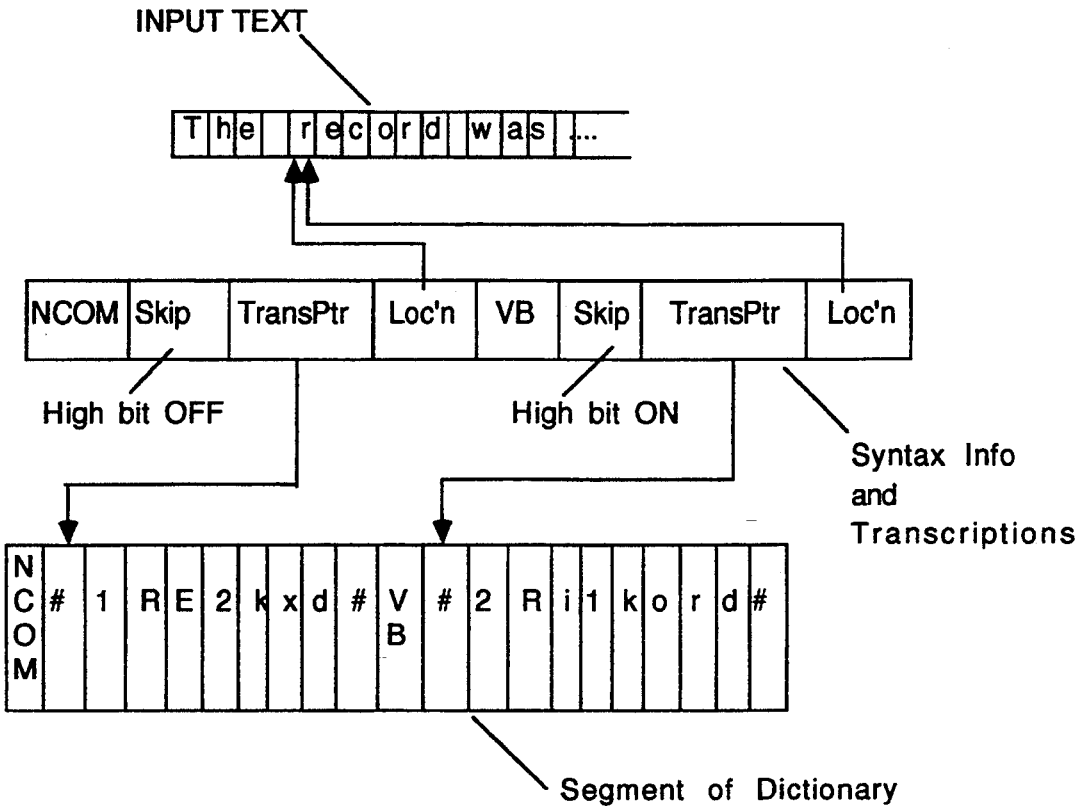
FIG. 3 illustrates the keying of syntactic information and transcriptions to locations in the input text.

Since multiple pronunciations may be associated with different syntax tags for a single word (and indeed as explained in the '966 patent each word may have multiple syntax tags), the structure shown in FIG. 2 preferably includes one bit in a delimiter tag called the "Skip Tag" (because the process must skip a fixed number of bytes to find the next tag) that indicates if this group of tags is the end of the list of all tags for a given word. This is illustrated in FIG. 3, which shows the relationship between the word "record" in an input text fragment "The record was" the Syntactic Info & Transcriptions 1030, and a segment of the Word Dictionary 1020. When a word was not found in the dictionary but had its transcription deduced by the OTP process, the transcription pointer points to the transcription written by the OTP module in some convenient place in memory, rather than pointing into the dictionary proper.

In contrast to Applicant's invention, other methods (e.g., that described in the Malsheen et al. patent) expand numbers as a first step in converting them into their word forms. Such expansion is intentionally left until later in Applicant's invention because numbers are easier to "parse" grammatically without all the extra words, i.e., they become a single tag in Applicant's TTS system, rather than multiple tags that themselves require elaborate parsing.

Modifications for Other Languages

The first step in adapting the TTS system 1001 to another language is obtaining a suitable Word Dictionary 1020 having grammatical tags and phonetic transcriptions associated with the entries as described above. The tag system would probably differ from the English examples described here since the rules of grammar and types of parts of speech would probably be different. The phonetic transcriptions would also probably involve a different set of symbols since phonetics also typically differ between languages.

The OTP process would also probably differ depending on the language. In some cases (like Chinese), it may not be possible to deduce pronunciations from orthography. In other cases (like Spanish), phonetics may be so closely related to orthography that most dictionary entries would only contain a transcription symbol indicating that OTP can be used. This would save memory.

On the other hand, it is believed that the dictionary look-up process and output format described here would remain substantially the same for all languages.

GRAMMAR LOOK-UP MODULES

The Grammar Look-up Modules 1040 operate substantially as those in the '966 patent, which pointed out that locations in the input text followed tags and nonterminals around during processing. As described above, in the TTS system 1001 transcription pointers and locations follow the tags around. It may be noted that the pointers and locations are not directly connected to the nonterminals, but their relationships can be deduced from other information. For example, the text locations of nonterminals and phonetic transcriptions are known, therefore the relationship between non-terminals and transcriptions can be derived whenever needed.

Structure of Grammar Tables

The Grammar Tables 1050 for the Phrase Dictionary, Phrase Combining Rules, and Sentence Checking Rules described in the '966 patent in connection with FIG. 3*a*, blocks 50-1, 50-2, and 50-3, are unchanged except for additions in the Phrase Dictionary to handle the proper-noun pre- and post-modifier tags described above.

Structure of Synth Log

Figure 4:
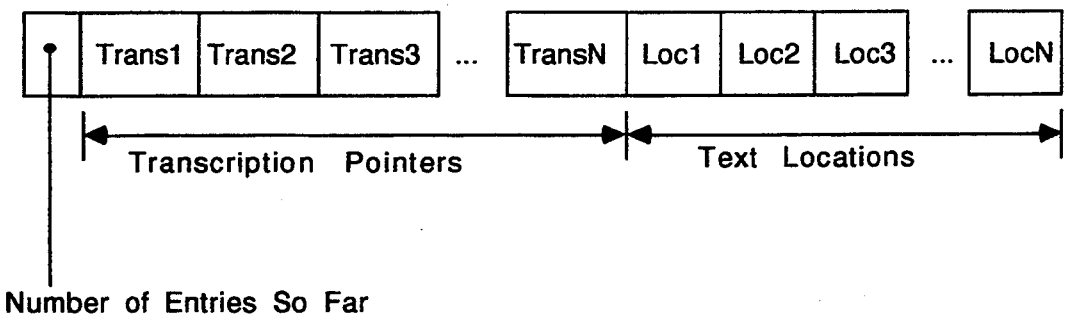
FIG. 4 shows a structure of a path in a synth_log in accordance with Applicant's invention.

The functions and characteristics of the Grammar Path Data Area 70 shown in FIGS. 1 and 3*a* of the '966 patent are effectively duplicated in the TTS system 1001 by a Grammar and Synth Log Data Area 1070 shown in FIG. 1. For the TTS system, the Grammar Log is augmented with a Synth Log, which includes one synth path for each grammar path. The structure of a grammar path is shown in FIG. 3*b* of the '966 patent. The structure of a corresponding synth path in the Synth Log is shown in FIG. 4. It is simply two arrays: one of the pointers Trans1 - TransN to transcriptions needed in a sentence, and the other of the pointers Loc1 - Loc N to locations in the input text corresponding to each transcription. The synth path also contains a bookkeeping byte to track the number of entries in the two arrays.

Grammar Module Processing

The processes implemented by the Grammar Modules 1040 are modified from those described in the '966 patent such that, as each tag is taken from the Syntactic Info and Transcriptions area 1030, if it can be used successfully in a path, its transcription pointer and location are added to the appropriate arrays on the corresponding synth path in the Synth Log. At the same time, the number-of-entries byte on that synth path is updated. In effect, the process implemented by the Grammar Modules 1040 does nothing with the phonetic transcriptions/locations but track which ones are used and (implicitly) the order of their use.

Modifications for Other Languages

Besides any appropriate changes to the tagging system as described above, it is necessary to have a grammar for the other language. The '966 patent gives the necessary information for a competent linguist to prepare a grammar with the aid of a native speaker of the other language.

PHONETICS EXTRACTOR

Processing Scheme

In the TTS system, the "best" grammar path in the Grammar and Synth Path Log 1070 is selected by the Phonetics Extractor 1080 for further processing. This is determined by evaluating the function 4*PthErr+NestDepth for each grammar path and selecting the path with the minimum value of this function, as described in Applicant's '966 patent in connection with FIGS. 3*b*, 7*a*, and 7*c*, among other places. The variable PthErr represents the number of grammatical errors on the path, and the variable NestDepth represents the maximum depth of nesting used during the parse.

If two paths have the same "best" value, one is chosen arbitrarily, e.g., the first one in the grammar path log to have the best score. If all grammar paths disappear, i.e., a total parsing failure, then the path log as it existed immediately prior to failure is examined according to the same procedure. The parsing process resumes immediately after the point of failure after the portion preceding the failure has been synthesized.

Figure 5:
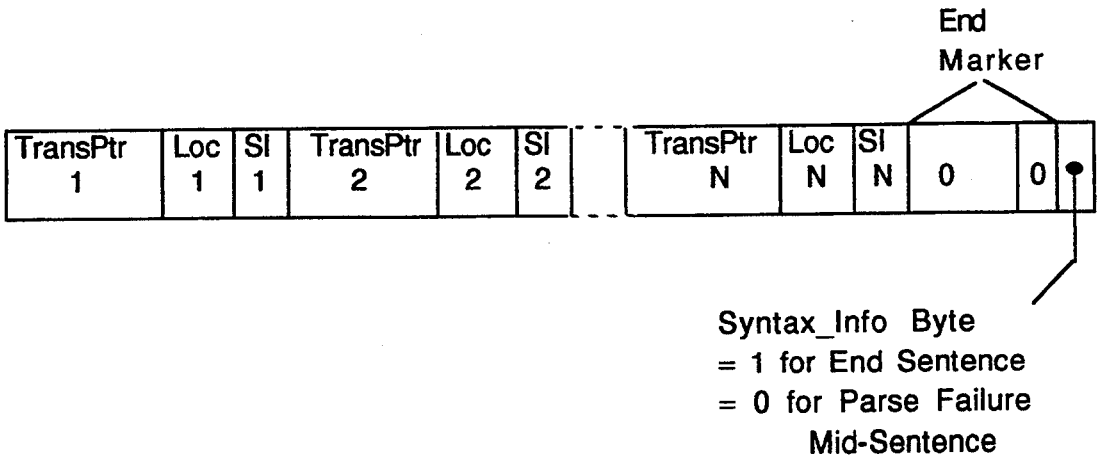
FIG. 5 shows a structure for transcription pointers and lotions in a synth_pointer_buffer in a TTS system in accordance with Applicant's invention.

The transcription pointers and locations for the identified path are copied by the Phonetics Extractor 1080 to a synth_pointer_buffer which has a format as shown in FIG. 5. In the figure, TransPtrn is a transcription pointer, Locn is a location in the input text, and SIn is a syntax_info byte. To flag the end of the list of transcriptions, a final entry having the transcription pointer and location both equal to zero is added.

The syntax_info byte added to each transcription/location pair is determined by examining the selected path in the grammar path log which contains information on nesting depth and non-terminals keyed to locations in the input text. For the final entry in the list, the syntax_info byte is set to "1" if this is the end of a sentence, and hence additional silence is required (and added) in the output to separate sentences. The syntax_info byte is set to "0" if this transcription string represents only a portion of a sentence (as would happen in the event of a total parsing failure in the middle of a sentence) and should not have silence added.

The syntax_info byte would be set to a predetermined value, e.g., Hex80, for a word needing extra stress, e.g., the last word in a noun phrase. It will be appreciated that extra stress could be added to all nouns. This results in various changes in prosodic style. The TTS system need not add extra stress to any words, but a mechanism for adding such additional stress is useful to stress words according to their grammatical roles.

If the grammar path log indicates that the nesting level changes immediately prior to a particular word, then the syntax_info byte would be set to another predetermined value, e.g., Hex40, if the sentence nested deeper at that point. The syntax_info byte would be set to other predetermined values, e.g., Hex01, Hex02, or Hex03, if the sentence un-nested by one, two, or three levels, respectively.

The synth_pointer_buffer is then examined by the Phonetics Extractor one transcription pointer at a time. If the transcription pointed to is a "?" then a transcription must be deduced for a numeric string in the input text. If the transcription pointed to is a "*" then the word in the input text is to be spelled out. If the transcription pointed to is a " ^ " then the input text contains a punctuation mark that requires prosodic interpretation. If the syntax_info byte is non-zero, stress ("[") or destress ("]") markers must be added to the output string produced by the Phonetics Extractor and stored in the Phonetic String with Prosody Markers 1090. Otherwise, the transcription retrieved from the Word Dictionary 1020 can be copied into the Phonetic String 1090 directly. Certain other words, e.g., "a" and "the" in the input text can trigger the following special cases: the pronunciation of the word "the" is changed from the default "q&&" to "qii" before words beginning with vowels; and the pronunciation of the word "a" is changed from the default "&&" to "ee" if the character in the input text is uppercase ("A").

Other special cases involve the grammar stress markers mentioned above. If the syntax_info byte is Hex80, the transcription is bracketed with the characters "[. . .]" to indicate more stress on that word. If the syntax_info byte is Hex40, a destress marker ("]") is placed before the word's transcription in the Phonetic String 1090. If the syntax_info byte is in the range 1 to 3, that number of stress markers is placed before the word, i.e., "[", "[[", or "[[[".

In the special case of input numeric character strings, which might be simple numbers, dates, or currency amounts, single digit numbers are looked up in a table of digit pronunciations, e.g., "2" —>1tuu##. Two-digit numbers are translated to "teens" if they begin with "1"; otherwise they are translated to a "ty" followed by a single digit, e.g., "37" —>1Qx2ti##1sE2vYn##. Three-digit blocks are translated to digit-hundred(s) followed by analysis of the final two digits as above. Four-digit blocks can be treated as two two-digit blocks, e.g., 1984—>1nJn2tiin##1ee2ti##1for##. In large numbers separated by commas, e.g., 1,247,361, each block of digits may be handled as above and words such as "million" and "thousand" inserted to replace the appropriate commas.

In the special case of input numeric text preceded by a dollar sign, e.g., $xx.yy, the number string xx can be converted as above, then the pronunciation of "dollar" or "dollars" can be added followed by "and", then the yy string can be converted as above and the pronunciation of "cents" added to the end.

Spell-outs are another special case, i.e., transcriptions realized by * indicate that the input word must be spelled out character by character. Accordingly, the Phonetics Extractor 1080 preferably accesses a special table storing pronunciations for the letters of the alphabet and common punctuation marks. It also accesses the table of digit pronunciations if necessary. Thus, input text that looks like "A1-B4" is translated to: ##1ee##1w&n##1hJ2fYn##1bii##1for##. Note that extra pause (silence) markers are added between the words to force careful and exaggerated pronunciations, which is normally desirable for text in this form.

In the TTS system 1001, punctuation marks have a "^" transcription. The various English punctuation marks are conveniently translated as follows, although other translations are possible:

| | |
|---|---|
| period | ## + ½ sec of silence |
| exclamation mark | ## + ½ sec of silence |
| question mark | ## + ½ sec of silence |
| & (ampersand) | 3And# |
| colon | #### |
| semi-colon | ## + ⅓ sec of silence |
| comma | #\|# |
| left paren | ##### |
| right paren | ## |
| quote mark | ## |
| double hyphen | ### |

Structure of Output

The Phonetic String with Prosody Markers 1090 generated by the Phonetics Extractor 1080 contains phonetic spellings with lexical stress levels, square bracket characters indicating grammatical changes in stress level, and the character "|" indicating punctuation that may need further interpretation. The string advantageously begins with the characters "xx" for a declaration, "xx?" for a question, and "xx!" for an exclamation. Such characters are added to the phonetics string based on the punctuation marks in the input sentence. The notation "xx?" is added to force question intonation later in the process; it is added only if the input text ends with a question mark and the question does not begin with "how" or a word starting with "wh". For example, if the input text is "Cats who eat fish don't get very fat" the Phonetic String 1090 is the following:

xx #1kAts#]2hu#1it#1fiS#[1dont#1gEt#2ve3ri1-fAt##

It will be noted that the underlined segment is destressed because it is a subordinate clause that is identified in the parsing process.

Modifications for Other Languages

The rules for special cases (currency, numbers, etc.) and insertion of grammar marks for prosody will differ from language to language, but can be implemented in a manner similar to that described above for English.

PROSODY GENERATOR

The Prosody Generator 1100 first modifies the Phonetic String with Prosody Marks 1090 to include additional marks for stress and duration (rhythm). Then it converts the result to a set of Diphone and Prosody Arrays 1110 on a diphone-by-diphone basis, specifying each successive diphone to be used and associated values of pitch, amplitude, and duration.

Rhythm and Stress Processing

The Prosody Generator 1100 examines the information in the Phonetic String 1090 syllable by syllable (each syllable is readily identified by its beginning digit that indicates its lexical stress level). If a low-stress syllable (e.g., stress level 2, 3, or 4) is followed by a high-stress syllable (stress level 1 or 2) and the difference in stress levels is two or more, the stress on the low-stress syllable is made one unit stronger.

If a syllable is followed by the punctuation marker "|" (or a silence interval followed by "|") or if it is at the end of the string, the syllable is enclosed in curly braces ({. . .}) and the entire word in which that syllable appears is enclosed in curly braces. The curly braces, or other suitable markers, are used to force extra duration (lengthening) of the syllables they enclose. In addition, the next word after a "|" mark is enclosed in square brackets ([. . .]) to give it extra stress.

The Prosody Generator 1100 makes rhythm adjustments to the Phonetic String 1090 by examining the patterns of lexical stress on successive syllables. Based on the number of syllables having stress levels 2, 3, or 4 that fall between succeeding syllables having stress level 1, the Prosody Generator brackets the leading stress-level-1 syllable and the intervening syllables with curly braces to increase or decrease their duration. The following bracketing scheme is currently preferred for English, but it will be appreciated that other schemes are suitable:

| syllable stress pattern | number of low stress syllables | syllable bracketing pattern |
|---|---|---|
| 1 1 | 0 | {{1}} 1 |
| 1 a 1 | 1 | {1} {{a}} 1 |
| 1 a b 1 | 2 | 1 {{a}} {{b}} 1 |
| 1 a b c 1 | 3 | 1 }a{ }b{ }c{ 1 |
| 1 a b . . . x 1 | ≧4 | 1 }}a{{ }}b{{ . . . }}x{{ 1 |

For handling the stress level patterns at the beginning and end of a sentence, the Prosody Generator assumes that stress-level-1 syllables precede and follow the sentence. Finally, the Prosody Generator 1100 strips the vertical bars "|" from the phonetic string and processes the result according to a Diphone-Based Prosody process.

Diphone-Based Prosody

If the phonetic string begins with "xx" or "xx!" characters, the Diphone-Based Prosody process in the Prosody Generator 1100 sets an intonation_mode flag for a declaration; if the Generator 1100 determines that the string begins with "xx?" the intonation_mode flag is set for a question. Also, if the string begins with "xx!" a pitch-variation-per-stress level (pvpsl) is set to a predetermined value, e.g., 25%; otherwise, the pvpsl is set to another predetermined value, e.g., 12%. The purpose of the pvpsl is described further below.

Figure 6:
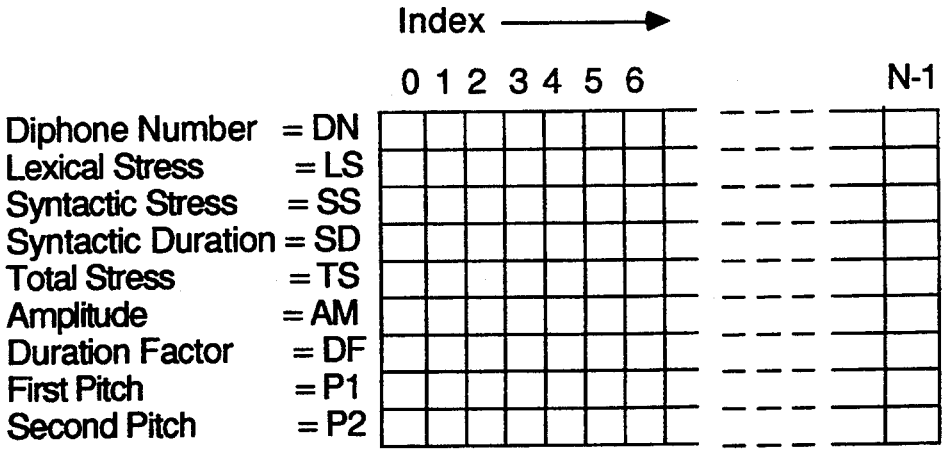
FIG. 6 shows a structure of prosody arrays produced by a diphone-based prosody module in accordance with Applicant's invention.

FIG. 6 shows the structure of the Prosody Arrays 1110 generated by the Diphone-Based Prosody process in the Prosody Generator 1100. The first arrays created from the Phonetic String are as follows: an array DN contains diphone numbers; an array LS contains the lexical stress for each diphone; an array SS contains the syntactic stress for each diphone; and an array SD contains the syntactic duration for each diphone. The other arrays shown in FIG. 6 are described below.

Figure 7A:
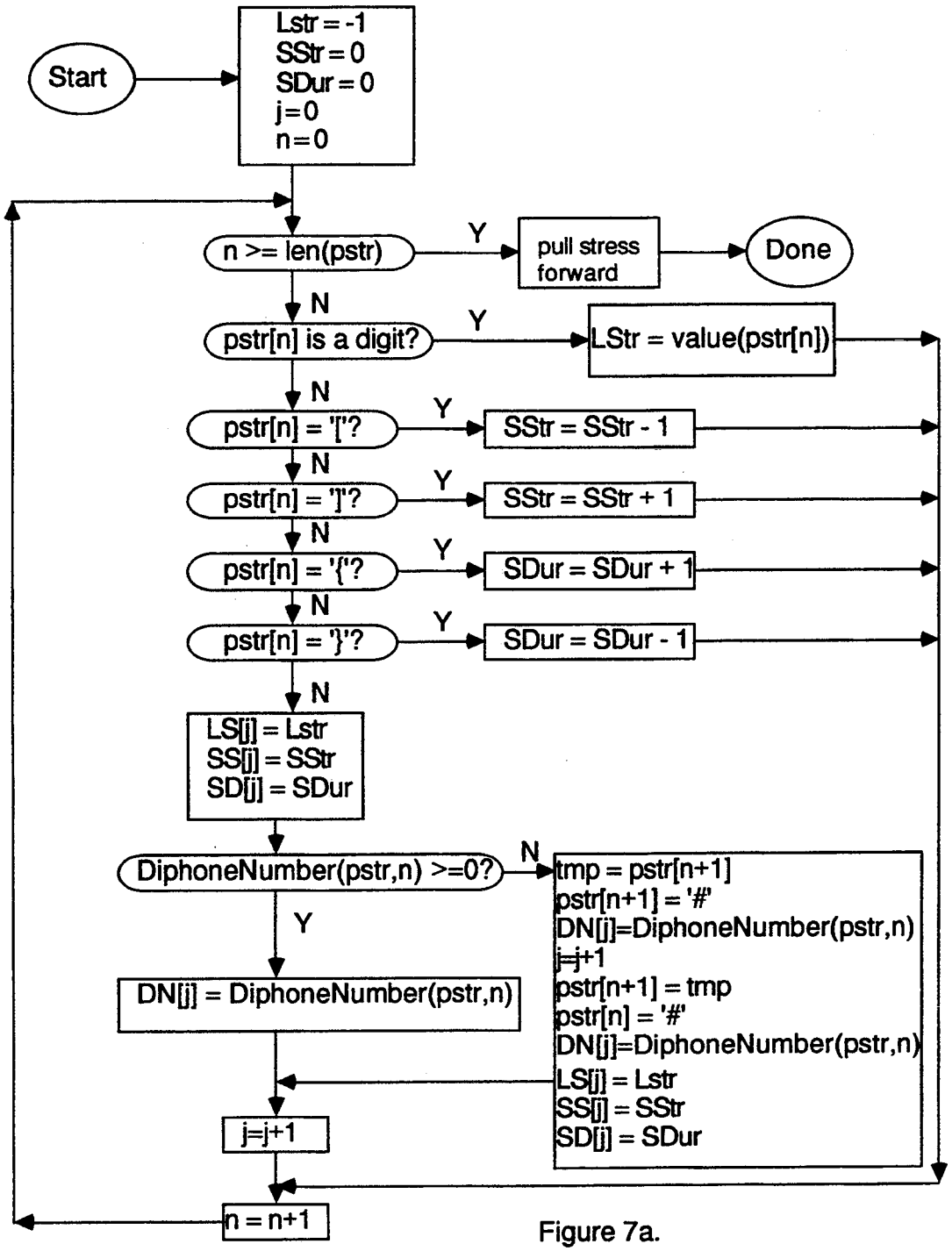
FIG. 7A is a flowchart of a process for generating the prosody arrays of FIG. 6.

FIG. 7A shows the Prosody Generator process that converts a phonetic string pstr in the Phonetic String with Prosody Markers 1090 into the arrays DN, LS, SS, and SD. Using an index n into the string that has a maximum value len(pstr), the process proceeds through the string, modifying a variable SStr representing current Syntactic Stress using the stress marks, modifying a variable SDur representing syntactic duration using the duration marks, and setting a current value LStr of lexical stress for all diphones in a syllable using the lexical stress marks. As seen in the figure, the process also accesses a program module called DiphoneNumber to determine the number assigned to each character pair that is a diphone.

Figure 7B:
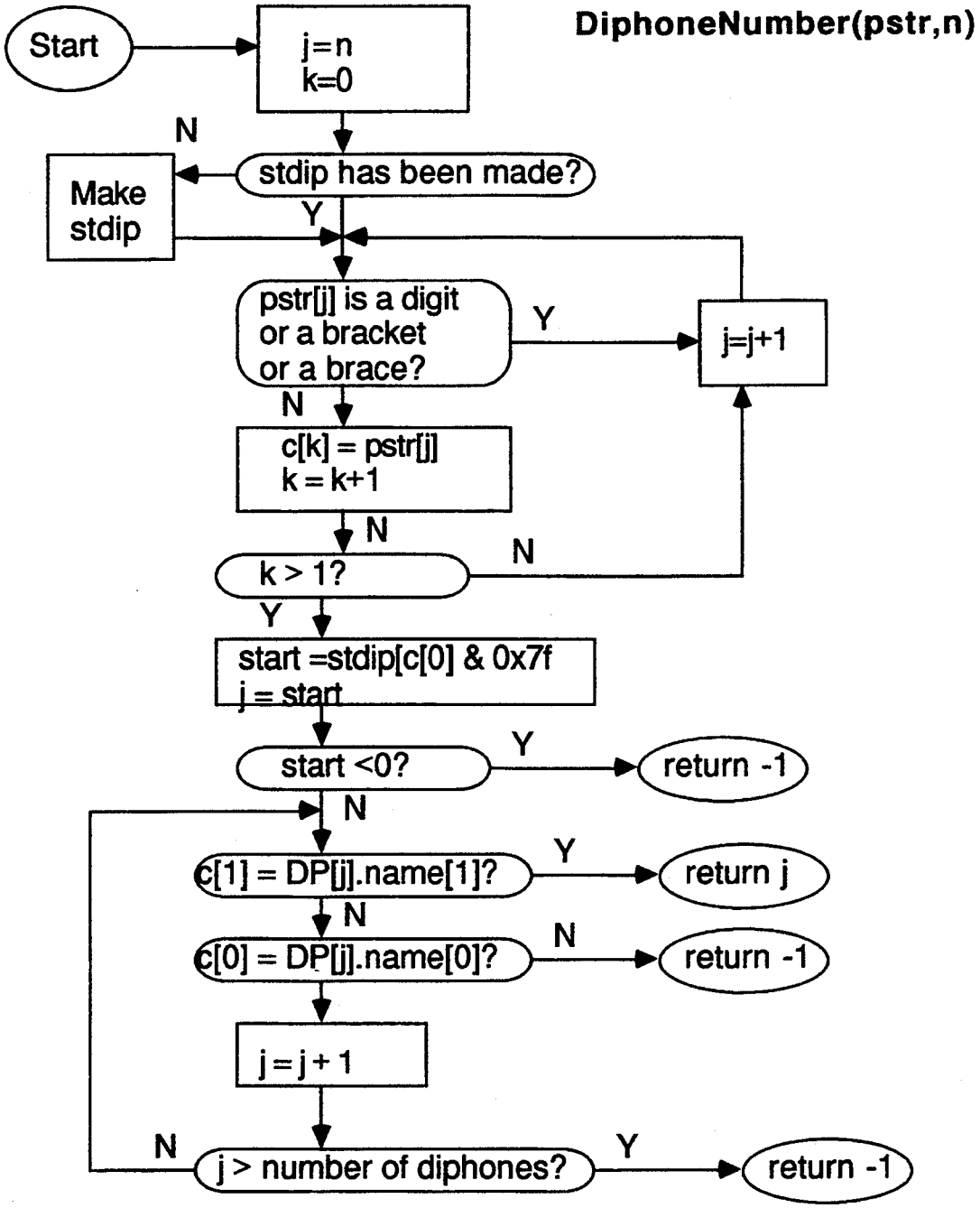
FIG. 7B is a flowchart of a DiphoneNumber module.

FIG. 7B is a flowchart of the DiphoneNumber module. The arguments to the DiphoneNumber module are a string of phonetic characters pstr and an index n into that string. The module finds the first two characters in pstr at or after the index that are valid phonetic characters (i.e., characters that are not brackets [, ], or braces {, }, or digits, in this embodiment). It then searches the list of diphones to determine if the pair is in the diphone inventory and if so it returns the diphone number assigned in the list to that diphone. If the pair is not a diphone, the routine returns a negative number as an error indicator.

Figure 7C:
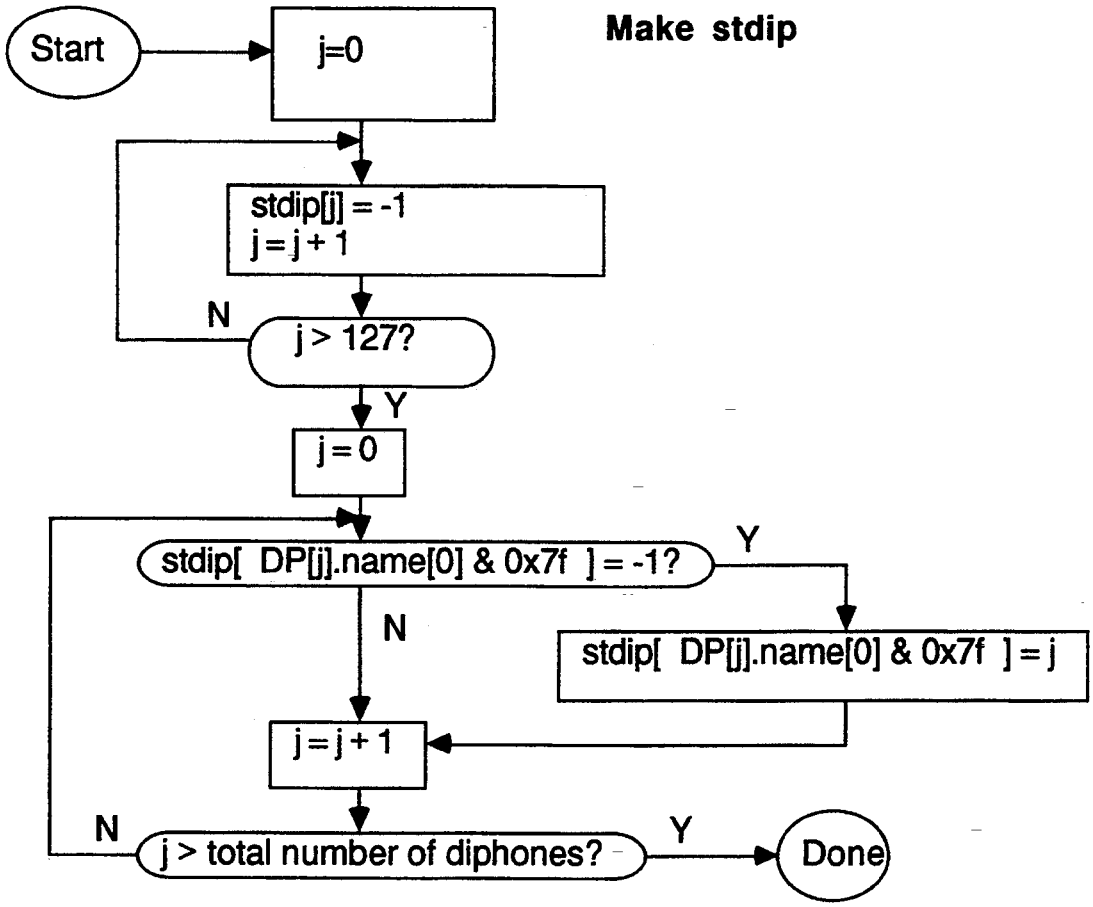
FIG. 7C is a flowchart of a process for constructing a stdip table.

The list of diphones employed by Applicant's current TTS system is given in Table IV below, and is stored in a convenient place in memory as part of the Diphone Waveforms 1130. The search of the diphone inventory is rendered more efficient by preparing, before the first search, a table stdip giving the starting location for all diphones having a given first character. A flowchart of the process for constructing the stdip table is shown in FIG. 7C. Referring again to FIG. 7A, if a character pair ab is not a diphone, the Prosody Generator replaces this pair with the two pairs a# and #b.

Figure 7D:
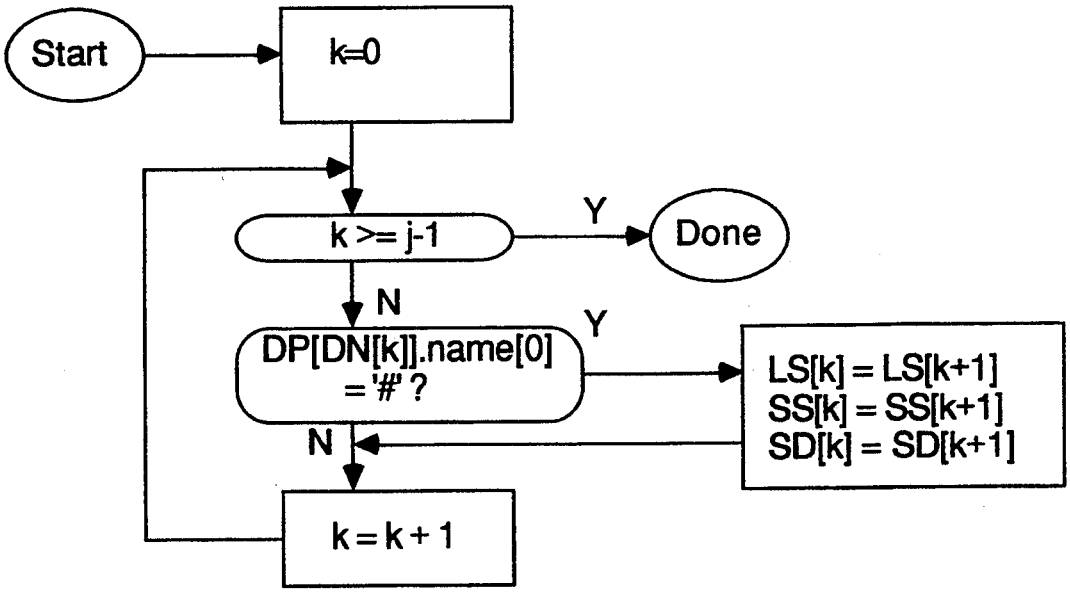
FIG. 7D is a flowchart of a pull-stress-forward module.

As a result of this process, the first diphone in each word (which is of the form #a) carries stress and duration values from the preceding word. Accordingly as shown in FIG. 7A, a program module makes another pass through the arrays to pull the stress and duration values forward by one location for diphones beginning with the symbol #. A flowchart of the pull-stress-forward module is shown in FIG. 7D.

The Prosody Generator 1100 also finds the minimum minSD of the entries in the SD array, and if minSD is greater than zero, it normalizes the contents of the SD array according to the following equation:

$$SD[j]=SD[j]-minSD.$$

The other arrays shown in FIG. 6 are a total stress array TS, an amplitude array AM, a duration factor array DF, a first pitch array P1, and a second pitch array P2, which are generated by the Prosody Generator 1100 from the DN, LS, SS, and SD arrays.

The total stress array TS is generated according to the following equation:

$$TS[j]=SS[j]+LS[j].$$

The Prosody Generator also finds the minimum minTS of the contents of the TS array, and normalizes those contents according to the following equation:

$$TS[j]=TS[j]-minTS+1.$$

The Prosody Generator 1100 generates the amplitude arrayAM as a function of the total stress in the TS array according to the following equation:

$$AM[j]=20-4*TS[j]$$

This results in an amplitude value of sixteen for the most highly stressed diphones and (typically) four for the least stressed diphones. The interpretation of these values is discussed below.

The duration factor array DF takes into account desired speaking rate, syntactically imposed variations in duration, and durations due to lexical stress. It is determined by the Prosody Generator from the following relationship:

$$DF[j]=Dur+SD[j]+4-LS[j]$$

where Dur is a duration value (typically ranging from zero to twelve) that establishes the overall speaking rate. It is currently preferred that the Prosody Generator clamp the value DF[j] to the range zero to sixteen.

The final values stored in the first pitch array P1 and second pitch array P2 are generated by the Prosody Generator 1100 based on four components: sentential effects, stress effects, syllabic effects, and word effects. The values in the P1 array represent pitch midway through each diphone and the values in the P2 array represent pitch at the ends of the diphones.

Figure 8:
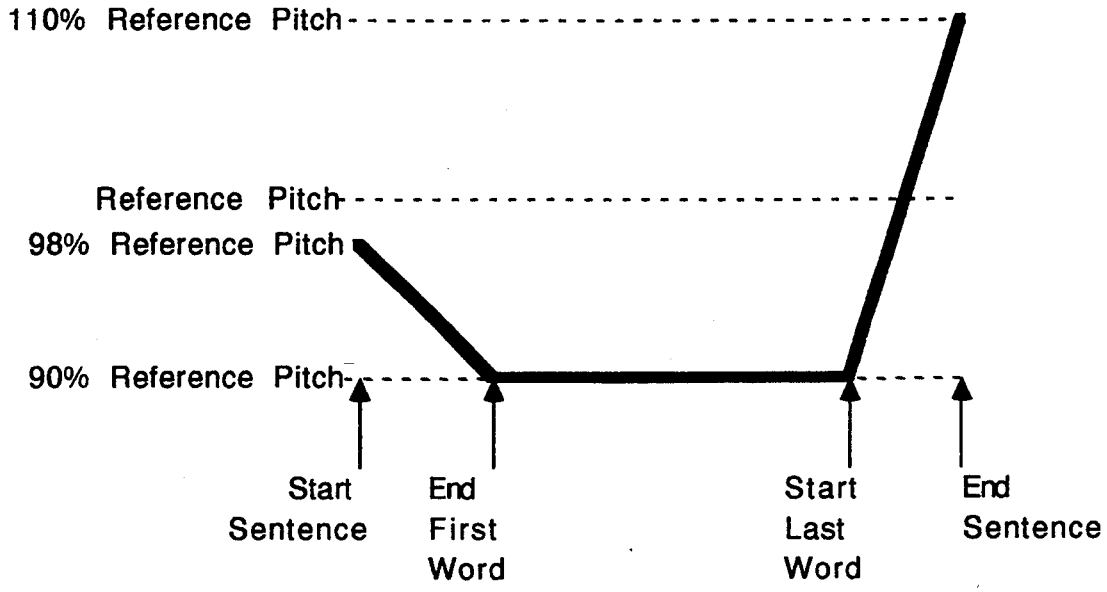
FIG. 8 illustrates pitch variations for questions in English.

The Prosody Generator 1100 handles sentential pitch effects by computing a baseline pitch value for each diphone based on the intonation mode. For declarations, the baseline pitch values are advantageously assigned by straight-line interpolation from an initial reference value at the first diphone to a value at the last diphone about 9% lower than the initial value. For questions, a suitable baseline for computing pitch values is shown in FIG. 8. The baseline reflects the typical form of English questions, in which pitch drops below a reference level on the first word and rises above the reference level on the last word of the sentence. It will be appreciated that baselines other than straight-line interpolation or FIG. 8 would be used for languages other than English.

For stress effects, the Prosody Generator first initializes the two pitch values Pi[j] and P2[j] for each diphone to the same value, which is given by the following equation:

$$baseline*pmod(pvpsl, TS[j])$$

where pvpsl is the pitch-variation-per-stress level described above and TS[j] is the total stress for the diphone j. The baseline value is as described above, and the function pmod(pvpsl,TS[j]) is given by the following table:

| TS[j] | pmod |
|---|---|
| 1 | 1 + 2*pvpsl |
| 2 | 1 + pvpsl |
| 3 | 1 |
| ≧4 | 1 − pvpsl |

For syllabic effects, the Prosody Generator resets Pi[j] to the baseline value if the diphone begins with silence or an unvoiced phoneme, and resets P2[j] to the baseline value if the diphone ends with silence or an unvoiced phoneme.

Finally for word effects, the Prosody Generator decreases both Pi[j] and P2[j] by an amount proportional to their distance into the current word such that the total drop in pitch across a word is typically 40 hertz (Hz) (in particular, 8 Hz per diphone if there are fewer than five diphones in the word). For the final word in the sentence, the drop is typically 16 Hz per diphone, but is constrained to be no greater than 68 Hz for the whole word.

Modifications for Other Languages

The Prosody Generator of Applicant's current TTS system could be modified to reflect the requirements of other languages. The rhythm adjustments based on syllable stress are needed only in some languages (e.g., English and German). Other languages (e.g., Spanish and Japanese) have all syllables of equal length; thus, a Prosody Generator for those languages would be simpler. The adjustments to duration and stress around punctuation marks and at the end of utterances are probably language-dependent, as are the relationships between amplitude, duration, pitch, and stress levels. For example, in Russian pitch decreases when lexical stress increases, which is the opposite of English.

WAVEFORM GENERATOR

In general, the Waveform Generator converts the information in the Diphone and Prosody Arrays into a digital waveform that is suitable for conversion to audible speech by a diphone-by-diphone process. The Waveform Generator also preferably implements a process for "coarticulation", by which gaps between words are eliminated in speech spoken at moderate to fast rates. Retaining the gaps can result in an annoying staccato effect, although for some applications, especially those in which very slow and carefully articulated speech is preferred, the TTS system can maintain those gaps.

The coarticulation process might have been placed in the Prosody Generator, but including it in the Waveform Generator is advantageous because only one procedure call (at the start of waveform generation) is needed rather than two calls (one for question intonation and one for declaration intonation). Thus, the coarticulation process is, in effect, a "cleanup" mechanism pasted onto the end of the prosody generation process.

Figure 9:
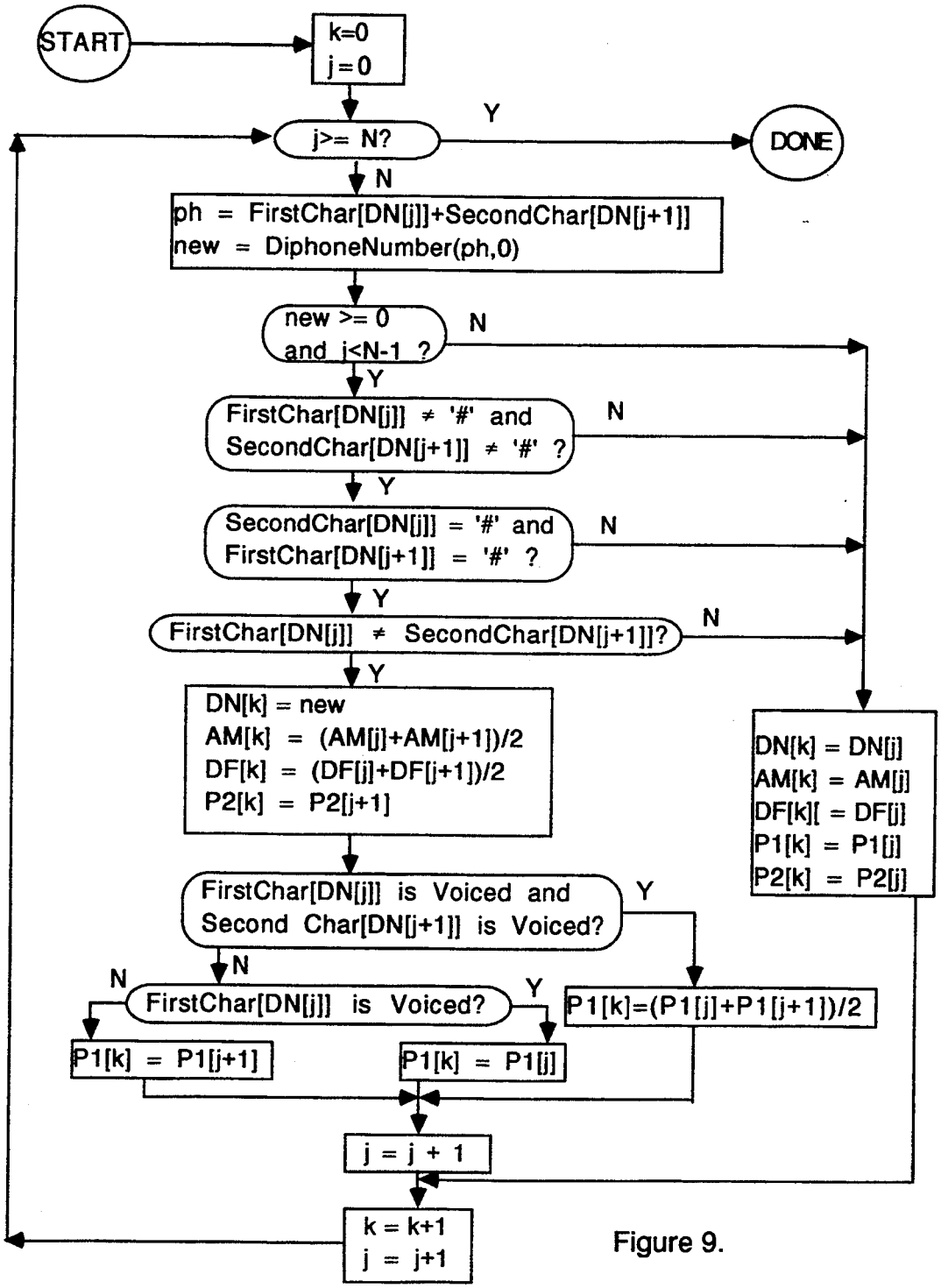
FIG. 9 is a flowchart of a coarticulation process in accordance with Appliant's invention.

FIG. 9 is a flowchart of the coarticulation process, which generates a number of arrays that are assumed to have N diphones, numbered 0 to N-1. The predefined arrays FirstChar[] and SecondChar[] contain the first and second characters, respectively, ordered by diphone number.

Using the process shown, the Waveform Generator 1120 removes instances of single silences (#) separating phonemes, appropriately smooths parameters, and closes up the Diphone and Prosody Arrays. If a sequence /a# #b/ provided to the coarticulation process cannot be reduced to a sequence /ab/ because the /ab/ sequence is not in the diphone inventory, then the sequence /a# #b/ is allowed to stand. Also, if /a/ and /b/ are the same phoneme, then the a# #b/ sequence is not modified by the Waveform Generator.

After the coarticulation process, the Waveform Generator proceeds to develop the digital speech output waveform by a diphone-by-diphone process. Linear predictive coding (LPC) or formant synthesis could be used to produce the waveform from the closed-up Diphone and Prosody Arrays, but a time-domain process is currently preferred to provide high speech quality with low computational power requirements. On the other hand, this time-domain process incurs a substantial cost in memory. For example, storage of high quality diphones for Applicant's preferred process requires approximately 1.2 megabytes of memory, and storage of diphones compressed by the simple compression techniques described below requires about 600 kilobytes.

It will be appreciated that Applicant's TTS system could use either a time-domain process or a frequency-domain process, such as LPC or formant synthesis. Techniques for LPC synthesis are described in chapters 8 and 9 of O'Shaughnessy, which are hereby incorporated in this application by reference, and in U.S. Pat. No. 4,624,012 to Lin et al. Techniques for formant synthesis are described in the above-incorporated chapter 9 of O'Shaughnessy, in D. Klatt, "Software for a Cascade/Parallel Formant Synthesizer", *J. Acoust. Soc. of Amer.* vol. 67, pp. 971–994 (March, 1980), and in the Malsheen et al. patent. With similar memory capacity available and substantially more processing power, an LPC-based waveform generator could be implemented that could provide better speech quality in some respects than does the time-domain process. Moreover, an LPC-based waveform generator would certainly offer additional flexibility in modifying voice characteristics, as described in the Lin et al. patent.

Most prior synthesizers use a representation of the basic sound unit (phoneme or diphone) in which the raw sound segment has been processed to decompose it into a set of parameters describing the vocal tract plus separate parameters for pitch and amplitude. The parameters describing the vocal tract are either LPC parameters or formant parameters. Applicant's TTS system uses a time-domain representation that requires less processing power than LPC or formants, both of which require complex digital filters.

Lower quality time-domain processes can also be implemented (e.g., any of those described in the above-cited Jacks et al. patent and U.S. Pat. Nos. 4,833,718 and 4,852,168 to Sprague). Such processes require substantially less memory than Applicant's approach and result in other significant differences in the waveform generation process.

About Diphones

Diphones (augmented by some triphones, as described above) are Applicant's preferred basic unit of synthesis because their use results in manageable memory requirements on current personal computers while providing much higher quality than can be achieved by phoneme- or allophone-based synthesis. The higher quality results because the rules for joining dissimilar sounds (e.g., by interpolation) must be very complex to produce natural sounding speech, as described in O'Shaughnessy at pp. 382–385.

An important feature of Applicant's implementation is the storage of diphones having non-uniform lengths, which is in marked contrast to other TTS systems. In Applicant's system, the diphones' durations are adjusted to correspond to length differences in vowels that result from the natures of the vowels themselves or the contexts in which they appear. For example, vowels tend to be shorter before unvoiced consonants and longer before voiced consonants. Also, tense vowels (e.g., /i/, /u/, /e/) tend to be longer than lax vowels (e.g., /I/, /&/, /E/). These tendencies are explained in detail in many books on phonetics and prosody, such as I. Lehiste, *Suprasegmentals*, pp. 18–30, MIT Press (1970).

The duration adjustments in Applicant's implementation are needed primarily for syntactically induced changes and to vary the speaking rate by uniform adjustment of all words in a sentence, not on a phoneme-by-phoneme basis to account for phonetic context. Phoneme- and allophone-based systems either must implement special rules to make these adjustments (e.g., the system described in the Malsheen et al. patent) or ignore these differences (e.g., the system described in the Jacks et al. patent) at the cost of reduced speech quality.

Structure of Stored Diphones

The currently preferred list of the stored diphones used for an English TTS system is given in Table IV below. In accordance with one aspect of Applicant's invention, the diphones are represented by signals having a data sampling rate of 11 kilohertz (KHz) because that rate is something of a standard on PC platforms and preserves all the phonemes from both males and females reasonably well. It will be appreciated that other sampling rates can be used; for example, if the synthetic speech is intended to be played only via telephone lines, it can be sampled at 8 KHz (which is the standard for telephone transmission). Such down-sampling to 8 KHz would save memory and result in no loss of perceived quality at the receiver beyond that normally induced by telephonic transmission of speech.

The diphones are stored in the Diphone Waveforms 1130 with each sample being represented by an eight-bit byte in a standard (mu-law) companded format. This format provides roughly twelve-bit linear quality in a more compact format. The diphone waveforms could be stored as eight-bit linear (with a slight loss of quality in some applications) or twelve-bit linear (with a slight increase in quality and a substantial increase in memory required).

One option in the current TTS system is the compression of the diphone waveforms to reduce the memory capacity required. Simple adaptive differential pulse code modulation (ADPCM) can reduce the memory required for waveform storage by roughly a factor of two. Applicant's current TTS system implements ADPCM (as described, for example, in O'Shaughnessy at pp. 273–274, which are hereby incorporated in this application by reference) applied directly to the companded signal with a four-bit quantizer and adapting the step size only. It will be noted that this reduces the quality of the output speech, and since Applicant's current emphasis is on speech quality further data reduction schemes in this area have not been implemented. It will be appreciated that many compression techniques are well known both for time-domain systems (see, e.g., the above-cited U.S. Patents to Sprague) and LPC systems (see O'Shaughnessy at pp. 358–375).

While it is currently preferred that the diphone waveforms be stored in random access memory (RAM), the inventory could in various circumstances be stored in read-only memory (ROM) or on another fast-access medium (e.g., a hard disk or a flash memory card), especially if RAM is very expensive in a given application but alternate cheap mass storage is available. As described in more detail below, the diphones waveforms are stored in three separate memory regions called SAMP, MARK, and DP in the Diphone Waveforms area 1130.

The raw waveforms representing each diphone are stored consecutively in memory in the area called SAMP. The MARK area contains a list of the successive lengths of pitch intervals for each diphone. Voiced intervals are given a positive length and unvoiced regions are represented by an integer giving the negative of the length.

The array DP contains, for each entry, information giving the two phoneme symbols in the diphone, the location in the SAMP area of the waveform, the length in the SAMP area of the waveform, the location in the MARK area of the pitch intervals (or marks), and the number of pitch intervals in the MARK area. The diphones are stored in the DP area in alphabetical order by their character names, and the DP area thus constitutes the diphone inventory accessed by the Prosody Generator 1100.

Certain diphones can uniformly substitute for other diphones, thus reducing the amount of data stored in the SAMP and MARK areas. The Waveform Generator performs such substitutions by making entries for the second diphones in the DP array but using pointers in their blocks in the DP array that point to descriptions in MARK and SAMP of some existing diphones. The currently preferred substitutions for English are listed in Table V below; in the Table, substitutions are indicated by the symbol "–>".

There are two classes of substitutions: those in which the substitution results in only a minor reduction in speech quality (e.g., substituting /t/ for /T/ in several cases); and those which result in no quality difference (e.g., substituting /ga/ for /gJ/ does not reduce speech quality because the /J/ diphone begins with an /a/ sound).

Diphone-by-Diphone Processing

The Waveform Generator produces the digital speech output of the TTS system through a process that proceeds on a diphone-by-diphone basis through the Diphone and Prosody Arrays 1110, constructing the segment of the speech output corresponding to each diphone listed in the DN array. In other words, for each index j in the array DN[], the raw diphone described in the DP, MARK, and SAMP areas (at location DN[j] in the DP area) is modified based on the information in AM[j], DF[j], Pi[j], and P2[j] to produce the output segment.

For each diphone j in the array DN[j], the Waveform Generator performs the following actions.

1. If the diphone was stored in a compressed format, it is decompressed.

2. Three points in the pitch contour of the diphone are established: a starting point, a mid point, and an end point. The starting point is the end of the previous diphone's pitch contour, except on the first diphone for which the start is set as P1[j]. The mid point is P1[j], and the end point is P2[j]. The use of three pitch points allows convex or concave shapes in the pitch contour for individual phonemes. In the following, if a diphone consists of an unvoiced region followed by voiced regions, only the pitch information from the mid to end points is used. If it consists of voiced segments followed by an unvoiced segment, only the information from the start to the mid point is used. Otherwise, all three points are used. Interpolation between the points is linear with each successive pitch interval.

3. An estimate of the number of pitch periods actually needed from this diphone is made by dividing the length of all voiced intervals in the stored diphone by an average pitch requested by the start, mid, and end pitch values in voiced regions.

4. If more voiced intervals are needed than actually exist in the stored diphone, the duration factor DF[j] is adjusted by the following equation to force elongation of the diphone:

$$DF[j]=DF[j]+(8*(needed-actual)+4)/actual$$

5. The Waveform Generator then steps through the successive intervals (specified in the MARK area) defining the diphone and does the following for each interval:

a. For unvoiced intervals, the samples are copied, with modification only to amplitude, to a storage area for the digital speech output signal, except as noted below for very high rate speech.

b. For voiced intervals, the samples are copied, with adjustment for both pitch and amplitude, to the output signal storage area.

Duration adjustments are then made by examining the duration factor DF[j] and a predefined table (given in Table III) that gives drop/duplicate patterns as a function of duration. The process steps horizontally across the table on successive intervals. Each table entry specifies duplicate (+1), drop (−1), or no change (0). If duplicate is specified, the interval samples are copied again. If drop is specified, counters are incremented to skip the next interval in the stored diphone.

Finally, the pitch is interpolated linearly either between start and mid points (for the first half of the diphone) or between mid and end points.

The Interval Copying Process

The Waveform Generator adjusts amplitude for both voiced and unvoiced intervals by additively combining the value of AM[j] with each companded sample in the interval. In this adjustment, positive values of AM[j] are added to positive samples and subtracted from negative samples. Likewise, negative values of AM[j] are subtracted from positive samples and added to negative samples. In both cases, if the resulting sample has a different sign from the original sample, the result is set to zero instead. This works because both the samples and the AM values are encoded roughly logarithmically. If the diphones are stored as linear waveforms, amplitude adjustment would proceed by multiplication by suitably converted values of AM.

In copying voiced intervals, the desired interval length is given by:

1/(desired_pitch)

Figure 10A:
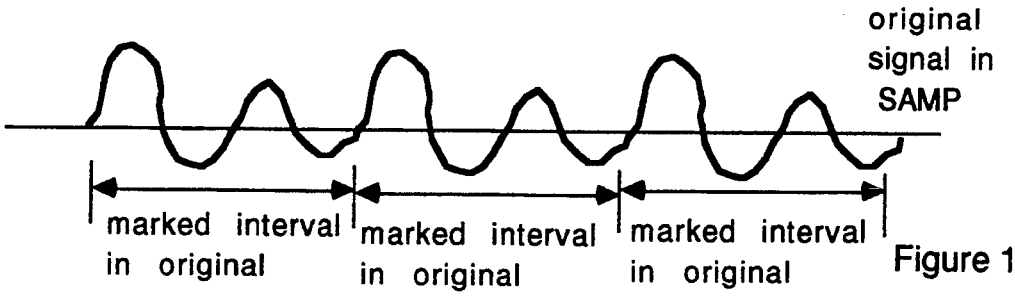
FIGS. 10A–10E illustrate speech waveform generation in accordance with Applicant's invention.
Figure 10B:
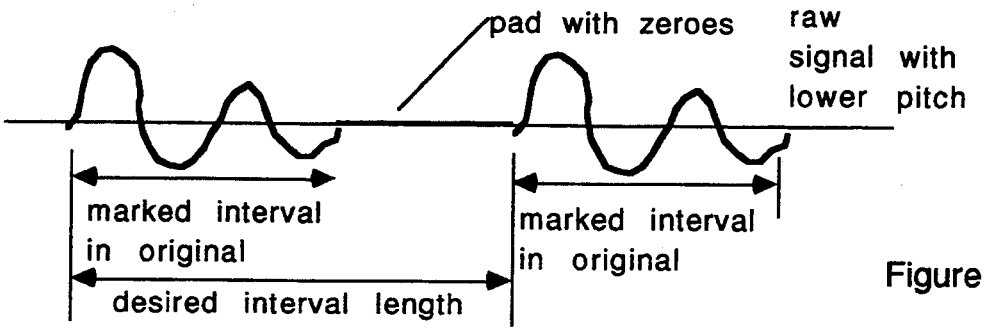

For voiced intervals, if the desired length is greater than the actual length in the stored diphone interval, the available samples are padded with samples having zero value to make up the desired length. This is illustrated by FIGS. 10A–10B. FIG. 10A represents three repetitions of a marked interval in an original stored diphone waveform, and FIG. 10B represents the padding of one of the original marked intervals to obtain a raw signal with desired lower pitch.

Figure 10C:
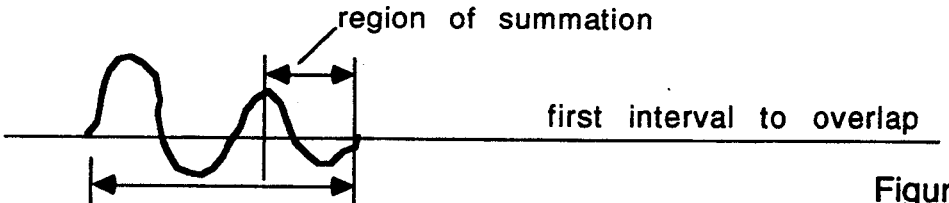
Figure 10D:
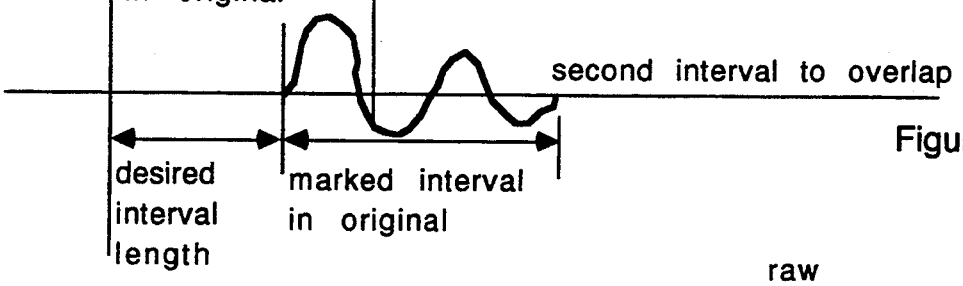
Figure 10E:
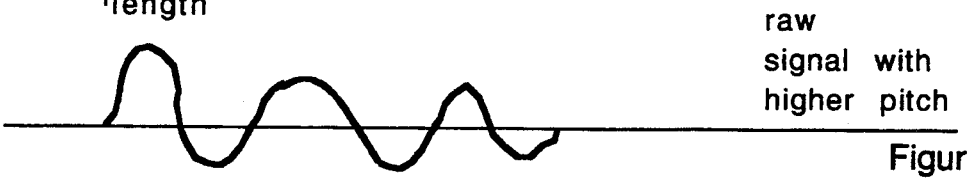

If the desired length is less than the actual length, the number of original samples falling in the desired length are taken for this interval; the remaining original samples are not discarded but are added into the beginning of the next interval. This is illustrated by FIGS. 10C–10E. FIG. 10C represents a marked interval in an original stored diphone waveform, indicating a region of remaining samples to be added to the next interval, which is illustrated by FIG. 10D.

Since this summation must be performed on linear rather than companded signals, the Waveform Generator converts the samples to be added to linear form, adds the converted samples, and converts the sums back to companded form. Standard tables for making such conversions are well known. The result of this process is shown in FIG. 10E, which illustrates the raw signal with desired higher pitch. Compared to processes that simply truncate the stored diphones and discard any truncated samples, Applicant's summation of overlapping adjacent intervals provides additional fidelity in the speech output signal, especially in those cases in which significant energy occurs at the end of an interval.

The above-described adjustments (especially for interval length) can result in annoying harshness in the speech output signal even when the interval marks have been set so that the points for insertion and deletion of signal fall in areas of lowest amplitude. Thus, on a sample by sample basis, the Waveform Generator preferably converts the companded signal (after amplitude and pitch adjustment) to a linear format and applies a digital filter to smooth out the discontinuities introduced. The digital filter maps a signal x[n] (where n is a sample index), viz., the raw pitch and amplitude adjusted signal, to a signal y[n], the smoothed signal, given by the equation:

$$y[n]=x[n]+(15/16)*x[n-1]$$

The linear signal y[n] is then converted back to companded (mu-law) form or left as a linear signal, depending on the output format required by the D/A converter that converts the digital speech output to analog form for reproduction.

High Speed Mode

For high rate speech, the Waveform Generator shortens unvoiced intervals during copying by removing 25% of the samples from the boundaries between unvoiced sounds and by removing samples from the silence areas. For the voiced intervals, the above-described interval-by-interval process referencing the Duration Array is used, but the Generator steps through every other voiced interval before applying the above logic, thereby effectively shortening voiced output segments by a factor of two compared to the output in normal mode for the same duration factor.

The above-described techniques for modification of duration and pitch are applications to the current data formats of well known time-domain manipulation techniques such as those described in D. Malah, "Time-Domain Algorithms for Harmonic Bandwidth Reduction and Time Scaling of Speech Signals", *IEEE Trans. on Acoustic, Speech and Signal Processing* vol. ASSP-27, pp. 121–133 (April, 1979) and F. Lee, "Time Compression and Expansion of Speech by the Sampling Method", *J. Audio Eng'g Soc.* vol. 20, pp 738–742 (November, 1972).

Sound Generation

The digital speech output waveform produced by the Waveform Generator 1120 may be immediately passed to a D/A converter or may be stored for later playback.

Modifications for Other Speakers/Voices

Producing synthetic speech that sounds like a different speaker simply requires digitizing speech from that speaker containing all diphones and extracting from the speech those segments that correspond to the diphones.

Modifications for Other Languages

Other languages naturally require their own diphone waveforms, which would be obtainable from a native speaker of the language, drawn up according to the phonetic structure of that language. This portion of the TTS system's processing is substantially independent of the language; only the Diphone Waveforms 1120 need adaptation.

TABLE I

Typical Word Dictionary Entries

| | | |
|---|---|---|
| record | NCOM #1RE2kxr# | VB #2Ri1kord# |
| invalid | NCOM #1In2v&3LYd# | ADJ #2In1vA2LYd# |
| 1,212 | NUMS #?# | |
| ain't | (BEM NEG) (BER NEG) (BEZ NEG) #*# | |
| etc. | AVRB #1Et#1sEt3tx2R&# | |
| jump | NCOM VB #1j&mp# | |

TABLE II

Phonetic Transcription Symbol Key

| | | | |
|---|---|---|---|
| Vowels | | | |
| a hOt | A bAt | e bAIt | E bEt |
| i bEEt | I bIt | o bOAt | O bOUght |
| u bOOt | U pUsh | & bUt | ) mamA |
| Y carrOt | x beepER | X titLE | |
| Diphthongs | | | |
| J wIre | W grOUnd | V bOY | |
| Glides | | | |
| y Yes | w Wet | | |
| Liquids | | | |
| R Road | r caR | L Leap | l faLL |
| Nasals | | | |
| m Man | n wheN | N haNG | |
| Stops | | | |
| b Bet | p Put | d heaD | D miDDle |
| t Take | T meTal | g Get | k Kit |

TABLE II-continued

Phonetic Transcription Symbol Key

| | | | |
|---|---|---|---|
| Affricates | | | |
| j Jet | c CHat | | |
| Fricatives | | | |
| f Fall | v Very | Q baTH | q baTHe |
| s Save | z Zoo | S SHoot | Z aZure |
| h Help | | | |
| Consonant Clusters | | | |
| % SPend | $ SKate | @ STand | |
| Other | | | |
| # silence | ? number | * can't say word | ^empty phone |

TABLE III

Contents of the Duration_Array

| duration factor | contents | | | | | | | |
|---|---|---|---|---|---|---|---|---|
| 16 | +1 | +1 | +1 | +1 | +1 | +1 | +1 | +1 |
| 15 | +1 | +1 | +1 | +1 | 0 | +1 | +1 | +1 |
| 14 | +1 | +1 | 0 | +1 | +1 | +1 | 0 | +1 |
| 13 | +1 | +1 | 0 | +1 | +1 | 0 | +1 | 0 |
| 12 | +1 | 0 | +1 | 0 | +1 | 0 | +1 | 0 |
| 11 | +1 | 0 | 0 | +1 | 0 | 0 | +1 | 0 |
| 10 | +1 | 0 | 0 | 0 | +1 | 0 | 0 | 0 |
| 9 | 0 | 0 | 0 | +1 | 0 | 0 | 0 | 0 |
| 8 | 0 | 0 | 0 | 0 | 0 | 0 | 0 | 0 |
| 7 | 0 | 0 | 0 | −1 | 0 | 0 | 0 | 0 |
| 6 | −1 | 0 | 0 | 0 | −1 | 0 | 0 | 0 |
| 5 | −1 | 0 | 0 | −1 | 0 | 0 | −1 | 0 |
| 4 | −1 | 0 | −1 | 0 | −1 | 0 | −1 | 0 |
| 3 | −1 | −1 | 0 | −1 | −1 | 0 | −1 | 0 |
| 2 | −1 | −1 | 0 | −1 | −1 | −1 | 0 | −1 |
| 1 | −1 | −1 | −1 | −1 | 0 | −1 | −1 | −1 |
| 0 | −1 | −1 | −1 | −1 | −1 | −1 | −1 | −1 |

TABLE IV

List of Diphones

| | | | | | | | | | | | | | | |
|---|---|---|---|---|---|---|---|---|---|---|---|---|---|---|
| ## | #& | #) | #@ | #I | #D | #J | #K | #L | #l | #X | #O | #R | #r | #S |
| #T | #U | #V | #W | #Y | #a | #b | #c | #d | #e | #f | #g | #h | #j | #k |
| #m | #n | #N | #p | #q | #t | #v | #w | #y | #z | #A | #E | #Q | #Z | #i |
| #o | #s | #u | #x | &# | && | &D | &N | &Q | &S | &T | &L | &R | &r | &x |
| &h | &w | &b | &c | &d | &f | &g | &j | &k | &l | &X | &m | &n | &p | &q |
| &s | &t | &v | &z | )# | )) | )L | )X | )Q | )R | )r | )x | )S | )T | )b |
| )c | )d | )f | )g | )h | )j | )k | )m | )n | )p | )s | )t | )v | )w | )D |
| )N | )l | )q | )z | @A | AA | AN | AS | AT | Ab | Ad | Af | Ak | Al | Am |
| An | Ap | Aq | As | At | Av | Az | A# | AD | AL | AX | AQ | AZ | Ac | Ag |
| Aj | Ar | AR | Ax | DS | DY | Di | Dx | D# | D) | DE | DI | DL | DR | Dr |
| DX | Da | De | Dl | Dn | Do | E# | ED | EE | EQ | ES | ET | Ed | Ef | Ej |
| Ek | El | Em | En | Ep | Eq | Er | Ex | Es | Et | Ev | Ez | EL | EX | ER |
| EZ | Eb | Ec | Eg | I# | ID | II | IN | IQ | IS | IT | IZ | IL | IX | IR |
| Ib | Ic | Id | If | Ig | Ij | Ik | Il | Ih | Im | In | Ip | Iq | Ir | Ix |
| Is | It | Iv | Iw | Iz | J# | J) | J& | JA | JD | JL | JQ | JR | JT | JX |
| JY | Ja | Jb | Jd | Jf | Jg | Ji | Jj | Jk | Jl | Jm | Jn | Jo | Jp | Jq |
| Jr | Js | Jt | Jv | Jw | Jx | Jy | Jz | L& | L# | L) | LA | LE | LI | LJ |
| LL | LR | Lr | LX | Ll | LO | LU | LV | LW | LY | La | Le | Lf | Li | Lb |
| Lc | Ld | Lg | Lj | Lk | Ln | Lm | Lp | Lq | Ls | Lt | Lv | Lw | Ly | Lz |
| LD | LQ | LS | LT | Lo | Lu | Lx | N# | N& | Nq | NQ | Ng | Ni | Nk | Nt |
| Nz | N) | N& | NL | Nl | NX | NS | Nb | Nd | Nf | Nh | Nn | Np | Nx | Nr |
| NR | Ny | O# | ON | OO | OS | OT | Oc | Od | Of | Og | Oi | Ok | Ol | On |
| Op | Os | Ot | Oz | OY | OI | Ox | OD | OL | OX | OQ | Ob | Oj | Or | OR |
| Q# | Q& | Q) | QA | QE | QO | QR | Qr | QV | QW | QY | Qi | Qo | Qs | Qx |
| Q) | QI | QJ | QL | Ql | QX | Qa | Qb | Qd | Qe | Qf | Qk | Qm | Qn | Qp |
| Qt | Qu | Qw | R# | RD | Rd | Rf | Rg | Rj | Rk | Rm | Rn | Rs | Rt | Rz |
| RQ | RS | Rb | Rc | Rp | Rq | Rv | Rw | RT | RZ | R& | R) | RA | RE | RI |
| RJ | RO | RX | RL | Rl | RV | RW | RY | Ra | Re | Ri | Ro | Ru | RU | Rx |
| RR | Rr | S# | SA | SI | SU | SX | SV | SW | SY | Se | Si | So | St | Su |
| Sx | S& | S) | SE | SJ | SL | Sl | SR | Sr | Sa | Sb | Sf | Sh | Sk | Sm |
| Sn | Sv | T# | T) | T& | TX | TY | Ti | TI | TL | Tl | Te | Tm | Tn | To |
| Ts | Tx | TR | Tr | U# | UT | UR | Ur | Ux | UU | Ud | Uk | Ul | UL | UX |
| Um | Ut | UD | US | Uc | Ug | Up | Us | V# | V) | V& | VL | VX | VY | VI |
| Vb | Vd | Vf | Vi | Vk | Vl | Vm | Vn | Vs | Vt | Vx | VR | Vr | Vy | Vz |
| W# | WD | WE | WI | WQ | WX | WY | Wb | Wc | Wd | Wi | Wl | WL | Wm | Wn |
| Wr | WR | Ws | Wt | Wx | Wz | X# | X& | X) | Xf | XL | XA | XE | X) | XU |
| XV | XW | XD | XR | Xr | XO | XQ | XS | Xa | Xb | Xc | Xe | Xj | Xk | Xo |
| Xp | Xq | Xv | Xw | Xu | Xy | XX | Xl | Xd | Xt | XI | XJ | XT | XY | Xg |
| Xi | Xm | Xn | Xs | Xx | Xz | Y# | YL | YX | YR | YS | YT | YY | Yb | Yd |

TABLE IV-continued

| List of Diphones | | | | | | | | | | | | | | |
|---|---|---|---|---|---|---|---|---|---|---|---|---|---|---|
| Yf | Yg | Yj | Yk | Yl | Ym | Yn | Yp | Ys | Yt | Yv | Yx | Yz | YD | YQ |
| YZ | Yc | Yh | Yr | Yw | ZY | ZI | Zu | Z# | Z) | Z& | Zd | Zi | Zw | Zx |
| Zr | ZR | aD | aa | ab | ac | ad | ag | aj | al | am | an | ap | ar | aR |
| ax | as | at | a# | aL | aX | aN | aQ | aS | aT | aZ | af | ah | ak | aq |
| av | az | b# | b& | bA | bE | bI | bJ | bL | bl | bO | bR | br | bU | bX |
| bV | bW | bY | b) | bd | bh | bm | bn | bs | bu | bw | ba | be | bi | bj |
| bo | bt | bv | bx | by | bz | c# | c& | c) | cV | cE | cL | cl | cO | cX |
| cb | cd | cf | ch | cm | cq | cn | ct | cA | cI | cJ | cW | cY | ca | ce |
| ci | co | cu | cx | cr | cy | d# | d& | dS | dX | dY | db | df | dh | dk |
| dl | dm | dn | dp | ds | dt | dv | dw | d) | dA | dE | dI | dJ | dL | dO |
| dR | dr | dV | dW | da | de | di | do | du | dx | dz | e# | eD | eL | eN |
| eS | eT | eb | ec | ed | ee | ei | ej | ek | el | em | en | ep | er | es |
| et | ev | ez | e) | e& | eQ | eR | eW | eX | eY | eI | eZ | ea | ef | eg |
| eh | eo | eq | ex | f# | f& | fA | fE | fI | fJ | fL | fl | fR | fr | fU |
| fV | fW | fX | fY | f) | fO | fQ | fT | fb | fg | fh | fi | fk | fn | fq |
| fw | fa | fe | fo | fs | ft | fu | fx | fy | g& | gA | gE | gI | gJ | gL |
| gl | gO | gR | gr | gU | gV | gX | gY | ga | ge | gj | gn | go | gw | gx |
| gy | gz | g# | g) | gW | gZ | gb | gd | gi | gm | gp | qu | h& | hA | hE |
| hI | hJ | hO | hV | hW | h) | hU | hY | ha | he | hi | ho | hu | hx | hr |
| hR | hy | i# | i) | i& | iA | iD | iL | iN | iQ | iT | iW | iY | iE | iI |
| iJ | iO | iR | iS | iX | iZ | ia | ib | ih | io | ic | id | ie | if | ig |
| ii | ij | ik | il | im | in | ip | iq | ir | is | it | iv | iw | ix | iy |
| iz | j# | j& | jA | jE | jJ | jV | jY | ja | jo | ju | jx | jr | jR | j) |
| jI | jL | jl | jO | jX | jd | je | ji | jm | jn | jt | k# | k& | k) | kA |
| kI | kJ | kL | kl | kO | kR | kr | kS | kU | kV | kW | kX | kY | ka | kc |
| ke | ki | kn | ko | ks | kt | kw | kx | ky | kE | kQ | kT | kd | kf | kg |
| kk | km | kp | ku | l# | l& | l) | lA | lR | lr | lf | li | lm | lo | lp |
| lq | ls | lv | lw | lx | ly | lz | lD | lJ | lL | ll | lX | lO | lQ | lS |
| lY | lI | lb | lc | ld | le | lg | lj | lk | ln | mA | mL | ml | mR | mr |
| mf | mh | mk | mm | mw | m# | m& | m) | mE | mI | mJ | mO | mQ | mV | mW |
| mX | mY | ma | mb | md | me | mi | mn | mo | mp | mq | ms | mt | mu | mx |
| my | mz | n& | n) | nA | nD | nE | nI | nJ | nL | nl | nQ | nS | nV | nW |
| nX | nY | na | nc | nd | ne | nf | ng | ni | nj | nk | nm | no | ns | nu |
| nv | nx | ny | nz | n# | nO | nR | nr | nT | nZ | nb | nh | nn | np | nq |
| nt | nw | o) | o& | oA | oD | oE | oI | oO | oR | oT | oZ | oa | ob | oe |
| oh | oj | ow | o# | oL | oX | oQ | oS | oY | oc | od | of | og | oi | ok |
| ol | om | on | oo | op | oq | or | os | ot | ov | ox | oz | p# | p& | p) |
| pA | pI | pJ | pL | pO | pR | pr | pU | pV | pW | pX | pY | pa | pe | pl |
| pi | pm | po | pq | ps | pt | px | py | pE | pQ | pS | pT | pc | pd | pf |
| ph | pk | pn | pu | pw | q) | qL | qX | ql | qY | qd | qz | q# | q& | qA |
| qW | qE | qI | qe | qi | qo | qx | qR | qr | r# | rD | rE | rL | rl | rT |
| rX | rY | rI | rd | rf | rg | ri | rj | rk | rm | rn | rs | rt | rz | r) |
| r& | rA | rJ | rO | rV | rW | ru | rU | rZ | rQ | rS | ra | rb | rc | re |
| ro | rp | rq | rv | rw | rx | rr | rR | s) | sQ | sR | sr | sS | sT | sb |
| sd | sf | sg | sh | sj | sn | sp | sq | ss | sw | sy | s# | s& | sA | sE |
| sI | sJ | sL | sl | sO | sV | sW | sX | sY | sa | sc | se | si | sk | sm |
| so | st | su | sx | tA | tE | tI | tJ | tL | tl | tO | tR | tr | tU | tV |
| tW | tY | ta | te | ti | tm | tn | to | tq | ts | tu | tw | tx | t# | t& |
| t) | tX | td | tf | tp | uA | uI | uR | uS | uT | uW | ub | uf | ug | ui |
| uj | uo | uq | ur | us | ut | uw | ux | u# | uD | uE | uL | uQ | uX | uY |
| uZ | uc | ud | ue | uk | ul | um | un | up | uu | uv | uz | v# | vA | vE |
| vI | vJ | vO | vR | vr | vV | vW | vX | vY | va | vd | ve | vi | vm | vn |
| vo | vq | vx | vy | vz | v& | v) | vL | vl | vb | vv | vw | wA | wW | wX |
| wl | wL | wu | w& | w) | wE | wI | wJ | wO | wU | wV | wY | wa | we | wi |
| wo | ws | wx | wr | wR | wz | x# | xL | xQ | xX | xY | xc | xd | xf | xg |
| xh | xi | xk | xl | xm | xn | xp | xq | xs | xt | xv | xz | x) | x& | xA |
| xD | xE | xI | xJ | xO | xR | xr | xS | xT | xZ | xa | xb | xe | xj | xo |
| xw | xx | xV | xW | xu | xU | y) | yA | yI | yO | yY | y& | yE | yX | yl |
| yL | ya | yi | yo | yu | ys | yx | yR | yr | z# | z& | zA | zE | zI | zJ |
| zW | zY | za | zb | zd | ze | zi | zn | zq | zx | z) | zL | zl | zO | zR |
| zr | zV | zX | zm | zo | zp | zt | zu | zw | | | | | | |

TABLE V

| Diphone Substitutions | | | |
|---|---|---|---|
| #) –> #& | #@ –> #s | #D –> #d | #J –> #a |
| #l –> #L | #X –> #L | #O –> #a | #r –> #R |
| #T –> #d | #U –> #& | #V –> #o | #W –> #A |
| #b –> #d | #c –> #d | #e –> #E | #g –> #d |
| #j –> #d | #k –> #d | #N –> #n | #p –> #d |
| #t –> #d | #Z –> #z | &D –> &d | &T –> &t |
| &L –> )L | &r –> &R | &x –> &R | &h –> )h |
| &w –> )w | &c –> &t | &j –> &d | &X –> &l |
| )) –> && | )X –> )L | )Q –> &Q | )R –> &R |
| )r –> &R | )x –> &R | )S –> &S | )T –> &t |
| )b –> &b | )c –> &t | )d –> &d | )f –> &f |
| )g –> &g | )j –> &d | )k –> &k | )m –> &m |
| )n –> &n | )p –> &p | )s –> &s | )t –> &t |
| )v –> &v | )D –> &d | )N –> &N | )l –> &l |

TABLE V-continued

| Diphone Substitutions | | | |
|---|---|---|---|
| )q –> &q | )z –> &z | AT –> At | AD –> Ad |
| AX –> AL | Ac –> At | Aj –> Ad | AR –> Ar |
| Ax –> Ar | DY –> dY | Di –> di | D# –> d# |
| D) –> d& | DE –> dE | DI –> dI | DL –> dL |
| DR –> dR | Dr –> dR | DX –> dX | Da –> da |
| De –> dE | Dn –> dn | Do –> do | E# –> &# |
| ED –> Ed | ET –> Et | Ej –> Ed | Ex –> Er |
| EX –> EL | Ec –> Et | I# –> &# | ID –> It |
| IT –> It | IX –> IL | Ic –> It | Id –> It |
| Ij –> It | Ih –> Yh | Ix –> Ir | Iw –> Yw |
| JD –> Jd | JT –> Jt | Jj –> Jd | L# –> l# |
| L) –> L& | LJ –> La | LL –> lL | LR –> lR |
| Lr –> lR | LX –> lL | Ll –> lL | LO –> La |
| LV –> Lo | LW –> LA | Le –> LE | Lf –> lf |

TABLE V-continued

| Diphone Substitutions | | | |
|---|---|---|---|
| Lb -> lb | Lc -> lc | Ld -> ld | Lg -> l# |
| Lj -> ld | Lk -> lk | Ln -> ln | Lm -> lm |
| Lp -> lp | Lq -> lq | Ls -> ls | Lt -> Xt |
| Lv -> lv | Lw -> lw | Ly -> ly | Lz -> lz |
| LD -> lD | LD -> ld | LQ -> lQ | LS -> lS |
| LT -> Xt | N& -> N) | Nl -> NL | NX -> NL |
| Nr -> Nx | NR -> Nx | O# -> a# | ON -> aN |
| OS -> aS | OT -> at | Oc -> at | Od -> ad |
| Of -> af | Og -> ag | Ok -> ak | Ol -> al |
| On -> an | Op -> ap | Os -> as | Ot -> at |
| Oz -> az | OI -> OY | OD -> ad | OL -> aL |
| OX -> aL | OQ -> aQ | Ob -> ab | Oj -> ad |
| Or -> ar | OR -> ar | QO -> Qa | Qr -> QR |
| QV -> Qo | QW -> QA | Qx -> qx | Q) -> Q& |
| QJ -> Qa | Ql -> QL | Qe -> QE | R# -> r# |
| RD -> rD | RD -> rd | Rd -> rd | Rf -> rf |
| Rg -> rg | Rj -> rd | Rk -> rk | Rm -> rm |
| Rn -> rn | Rs -> rs | Rt -> rt | Rz -> rz |
| RQ -> rQ | RS -> rS | Rb -> rb | Rc -> rc |
| Rc -> rt | Rp -> rp | Rq -> rq | Rv -> rv |
| Rw -> rw | RT -> rt | RZ -> xZ | R) -> R& |
| RJ -> Ra | RO -> Ra | RL -> RX | Rl -> RX |
| RV -> Ro | RW -> RA | Re -> RE | RR -> Rx |
| Rr -> Rx | SV -> So | SW -> SA | Se -> SE |
| S) -> S& | SJ -> Sa | Sl -> SL | Sr -> SR |
| T# -> t# | T) -> t& | T& -> t& | Tl -> TL |
| Tn -> tn | Ts -> ts | TR -> tR | Tr -> tR |
| U# -> u# | UT -> Ut | UR -> uR | Ur -> ur |
| Ux -> ux | UL -> Ul | UX -> Ul | UD -> Ud |
| Uc -> Ut | V& -> V) | VI -> VY | VR -> Vx |
| Vr -> Vx | WD -> Wd | Wc -> Wt | WL -> Wl |
| WR -> Wr | X& -> L& | X) -> L& | Xf -> lf |
| XA -> LA | XE -> LE | X) -> La | XU -> LU |
| XV -> Lo | XW -> LA | XD -> Xd | XR -> lR |
| Xr -> lR | XO -> lO | XQ -> lQ | XS -> lS |
| Xa -> La | Xb -> lb | Xc -> lc | Xe -> LE |
| Xj -> ld | Xk -> lk | Xo -> Lo | Xp -> lp |
| Xq -> lq | Xv -> lv | Xw -> lw | Xu -> Lu |
| Xy -> ly | XX -> XL | Xl -> XL | XT -> Xt |
| Y# -> &# | YX -> YL | YT -> Yt | Yj -> Yd |
| Yx -> Yr | YD -> Yd | Yc -> Yt | ZI -> ZY |
| Z& -> Z) | Zr -> Zx | ZR -> Zx | aD -> ad |
| ac -> at | aj -> ad | aR -> ar | ax -> ar |
| aX -> aL | aT -> at | bJ -> ba | bl -> bL |
| bO -> ba | br -> bR | bV -> bo | bW -> bA |
| b) -> b& | bm -> b# | be -> bE | bj -> b# |
| bt -> b# | cV -> co | cl -> cL | cO -> ca |
| cJ -> ca | cW -> cA | ce -> cE | cr -> kR |
| dS -> DS | dl -> Dl | dw -> d# | d) -> d& |
| dJ -> da | dO -> da | dr -> dR | dV -> do |
| dW -> dA | de -> dE | eD -> ed | eT -> et |
| ec -> et | ej -> ed | e& -> e) | eI -> eY |
| fJ -> fa | fl -> fL | fr -> fR | fV -> fo |
| fW -> fA | f) -> f& | fO -> fa | fT -> ft |
| fe -> fE | gJ -> ga | gl -> gL | gO -> ga |
| gr -> gR | gV -> go | ge -> gE | gj -> gd |
| g) -> g& | gW -> gA | gp -> g# | hJ -> ha |
| hO -> ha | hv -> ho | hW -> hA | h) -> h& |
| he -> hE | hr -> hx | hR -> hx | iD -> id |
| iT -> it | iW -> iA | iJ -> ia | iO -> ia |
| ic -> it | ie -> iE | ij -> id | jJ -> ja |
| jv -> jo | jr -> jx | JR -> jx | j) -> j& |
| jl -> jL | jO -> ja | je -> jE | k) -> k& |
| kJ -> ka | kl -> kL | kO -> ka | kr -> kR |
| kV -> ko | kW -> kA | kc -> kt | ke -> kE |
| kT -> kt | kg -> k# | l) -> l& | lA -> LA |
| lr -> lR | lD -> ld | lJ -> l& | ll -> lL |
| lX -> lL | lI -> lY | lg -> l# | lj -> ld |
| ml -> mL | mr -> mR | m) -> m& | mJ -> ma |
| mO -> ma | mV -> mo | mW -> mA | me -> mE |
| n) -> n& | nD -> nd | nJ -> na | nl -> nL |
| nV -> no | nW -> nA | nc -> nt | ne -> nE |
| nJ -> nd | nO -> na | nr -> nR | nT -> nt |
| oD -> od | oO -> oa | oT -> ot | oe -> oE |
| oj -> od | oX -> oL | oc -> ot | p) -> p& |
| pJ -> pa | pO -> pa | pr -> pR | pV -> po |
| pW -> pA | pe -> pE | pl -> pL | pt -> p# |
| pT -> pt | pc -> pt | pd -> p# | q) -> q& |
| qX -> gL | ql -> gL | qW -> qA | qe -> qE |
| qR -> QR | qr -> QR | rD -> rd | rl -> rL |
| rT -> rt | rI -> rY | rj -> rd | rJ -> ra |

TABLE V-continued

| Diphone Substitutions | | | |
|---|---|---|---|
| rO -> ra | rV -> ro | rW -> rA | ru -> Ru |
| rU -> RU | rZ -> xZ | rc -> rt | re -> rE |
| rr -> rx | rR -> rx | s) -> s& | sr -> sR |
| sT -> st | sj -> sd | sJ -> sa | sl -> sL |
| sO -> sa | sV -> so | sW -> sA | sc -> st |
| se -> sE | sk -> sg | tJ -> ta | tl -> tL |
| tO -> ta | tr -> tR | tV -> to | tW -> tA |
| te -> tE | t) -> t& | uT -> ut | uW -> uA |
| uj -> ud | uD -> ud | uc -> ut | ue -> uE |
| vJ -> va | vO -> va | vr -> vR | vV -> vo |
| vW -> vA | ve -> vE | v) -> v& | vl -> vL |
| wW -> wA | wl -> wX | wL -> wX | w) -> w& |
| wJ -> wa | wO -> wa | wV -> wo | we -> wE |
| wr -> wx | wR -> wx | xc -> x# | xg -> x# |
| x& -> x) | xD -> xd | xJ -> xa | xO -> xa |
| xr -> xR | xT -> xt | xe -> xE | xj -> xd |
| xV -> RV | xW -> RW | xu -> Ru | xU -> RU |
| y) -> y& | yA -> yE | yO -> ya | yl -> yX |
| yL -> yX | yR -> yx | yr -> yx | zJ -> za |
| zW -> zA | ze -> zE | z) -> z& | zl -> zL |
| zO -> za | zr -> zR | zV -> zo | |

The foregoing description of the invention is intended to be in all senses illustrative, not restrictive. Modifications and refinements of the embodiments described will become apparent to those of ordinary skill in the art to which the present invention pertains, and those modifications and refinements that fall within the spirit and scope of the invention, as defined by the appended claims, are intended to be included therein.

What is claimed is:

1. A system for synthesizing a speech signal from strings of words, comprising:

means for entering into the system strings of characters comprising words;

a first memory, wherein predetermined syntax tags are stored in association with entered words and phonetic transcriptions are stored in association with the syntax tags;

parsing means, in communication with the entering means and the first memory, for grouping syntax tags of entered words into phrases according to a first set of predetermined grammatical rules relating the syntax tags to one another and for verifying the conformance of sequences of the phrases to a second set of predetermined grammatical rules relating the phrases to one another, wherein the sequences of the phrases correspond to the entered words;

first means, in communication with the parsing means, for retrieving from the first memory the phonetic transcriptions associated with the syntax tags grouped into phrases conforming to the second set of rules, for translating predetermined strings of entered characters into words, and for generating strings of phonetic transcriptions and prosody markers corresponding to respective strings of entered and translated words;

second means, in communication with the first means, for adding markers for rhythm and stress to the strings of phonetic transcriptions and prosody markers and for converting the strings of phonetic transcriptions and prosody markers into arrays having prosody information on a diphone-by-diphone basis;

a second memory, wherein predetermined diphone waveforms are stored; and third means, in communication with the second means and the second memory, for retrieving diphone waveforms corresponding to the entered and translated words from the second memory, for adjusting the retrieved diphone waveforms based on the prosody information in the arrays, and for concatenating the adjusted diphone waveforms to form the speech signal.

2. The synthesizing system of claim 1, wherein the first means interprets punctuation characters in the entered character strings as requiring various amounts of pausing, deduces differences between entered character strings having declarative, exclamatory, and interrogative punctuation characters, and places the deduced differences in the strings of phonetic transcriptions and prosody markers.

3. The synthesizing system of claim 2, wherein the first means generates and places markers for starting and ending predetermined types of clauses in a synth log.

4. The synthesizing system of claim 1, wherein the second means adds extra pauses after highly stressed entered words, adjusts duration before and stress following predetermined punctuation characters in the entered character strings, and adjusts rhythm by adding marks for more or less duration onto phonetic transcriptions corresponding to selected syllables of the entered words based on a stress pattern of the selected syllables.

5. The synthesizing system of claim 1, wherein the third means adjusts the retrieved diphone waveforms for coarticulation.

6. The synthesizing system of claim 1, wherein the parsing means verifies the conformance of a plurality of parallel sequences of phrases and phrase combinations to the second set of grammatical rules, each of the plurality of parallel sequences comprising a respective one of the sequences possible for the entered words.

7. In a computer, a method for synthesizing a speech signal by processing natural language sentences, each sentence having at least one word, comprising the steps of:

entering a sentence;

storing the entered sentence;

finding syntax tags associated with the words of the stored entered sentence in a word dictionary;

finding in a phrase table non-terminals associated with the syntax tags associated with the entered words as each word is entered;

tracking, in parallel as the words are entered, a plurality of possible sequences of the found non-terminals;

verifying the conformance of sequences of the found non-terminals to rules associated with predetermined sequences of non-terminals;

retrieving, from the word dictionary, phonetic transcriptions associated with the syntax tags of the entered words of one of the sequences conforming to the rules;

generating a string of phonetic transcriptions and prosody markers corresponding to the entered words of said one sequence;

adding markers for rhythm and stress to the string of phonetic transcriptions and prosody markers and converting said string into arrays having prosody information on a diphone-by-diphone basis;

retrieving, from a memory wherein predetermined diphone waveforms are stored, diphone waveforms corresponding to said string and the entered words of said one sequence;

adjusting the retrieved diphone waveforms based on the prosody information in the arrays; and concatenating the adjusted diphone waveforms to form the speech signal.

8. The synthesizing method of claim 7, wherein the generating step comprises the steps of interpreting punctuation characters in the entered sentence as requiring corresponding amounts of pausing, deducing differences between declarative, exclamatory, and interrogative sentences, and placing the deduced differences in the string of phonetic transcriptions and prosody markers.

9. The synthesizing method of claim 8, wherein the generating step includes placing markers for starting and ending predetermined types of clauses in a synth log.

10. The synthesizing method of claim 7, wherein the adding step comprises the steps of adding extra pauses after highly stressed entered words, adjusting duration before and stress following predetermined punctuation characters in the entered sentence, and adjusting rhythm by adding marks for more or less duration onto phonetic transcriptions corresponding to selected syllables of the entered words based on a stress pattern of the selected syllables.

11. The synthesizing method of claim 7, wherein the adjusting step comprises adjusting the retrieved diphone waveforms for coarticulation.

* * * * *